United States Patent [19]

Atchisson

[11] Patent Number: 4,893,547

[45] Date of Patent: Jan. 16, 1990

[54] BOLT MECHANISM FOR FIRE ARM

[76] Inventor: Maxwell G. Atchisson, 6695 Ridgemoore Dr., Doraville, Ga. 30360

[21] Appl. No.: 96,934

[22] Filed: Sep. 14, 1987

Related U.S. Application Data

[60] Division of Ser. No. 784,157, Oct. 4, 1985, Pat. No. 4,693,170, which is a division of Ser. No. 639,526, Aug. 8, 1984, Pat. No. 4,553,469, which is a continuation of Ser. No. 336,328, Dec. 31, 1981, abandoned.

[51] Int. Cl.[4] ..... F41D 5/04

[52] U.S. Cl. ..... 89/187.01

[58] Field of Search ..... 89/165, 173, 187.01

[56] References Cited

U.S. PATENT DOCUMENTS 981,210 1/1911 Menteyne et al. ..... 89/165

1,043,670 11/1912 Chronis ..... 89/187.01

2,775,166 12/1956 Janson ..... 89/191.01

3,540,147 11/1970 Cream et al. ..... 89/187.01

*Primary Examiner*—Stephen C. Bentley

*Attorney, Agent, or Firm*—Jones, Askew & Lunsford

[57] ABSTRACT

A locked breach, gas operated long action firearm capable of firing heavy caliber shotgun or rifle shells with substantially reduced recoil. The gas piston and bolt carrier assembly are supported for recoil movement along a single guide rod which extends the entire length of the gun, permitting a longer recoil path resulting in reduced impulse due to recoil. The guide rod has a noncircular or radially-assymmetrical cross-section mating with a corresponding opening in the gas piston, so that the bolt carrier assembly remains in alignment over the entire recoil path. Separate close-bolt and open-bolt embodiments are disclosed, and the open-bolt embodiment is selectively capable of firing either semi-automatic or full-automatic while permitting reliable cartridge feeding from a box or drum magazine.

7 Claims, 18 Drawing Sheets

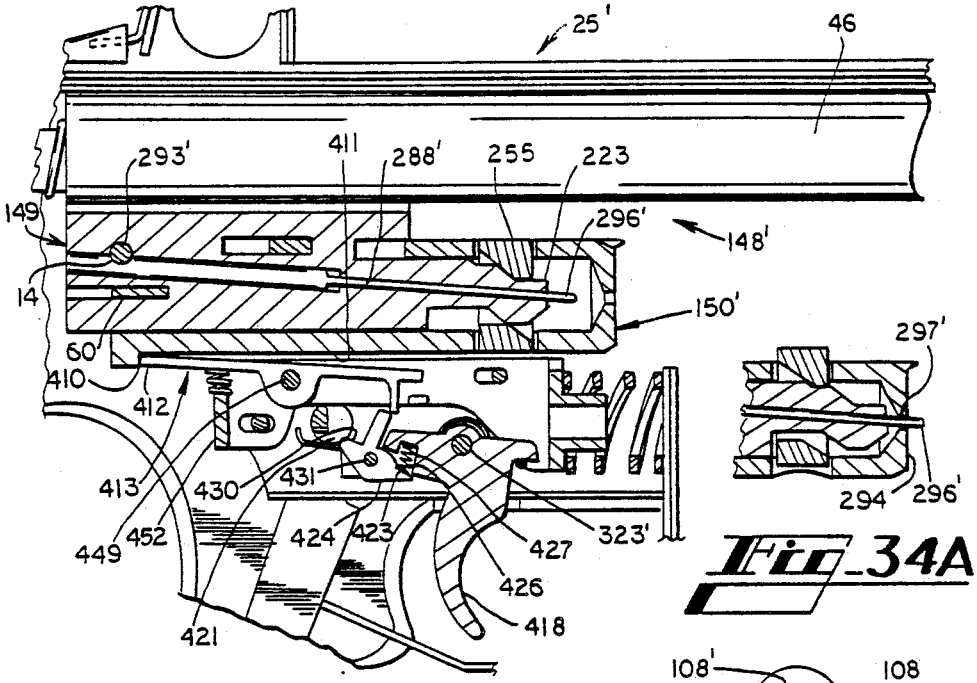
Fig. 32
Fig. 34A
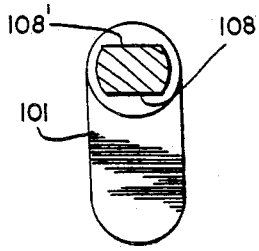
Fig. 10B
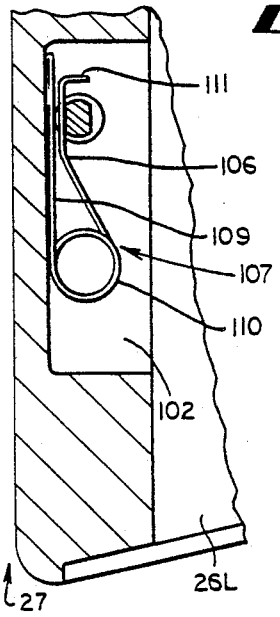
Fig. 9
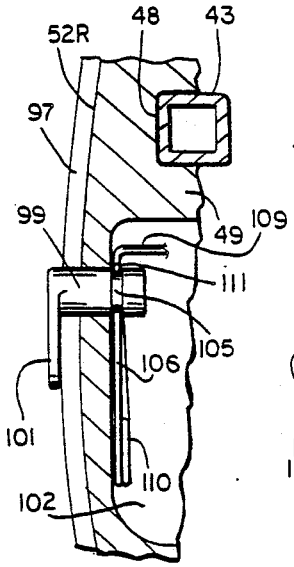
Fig. 10
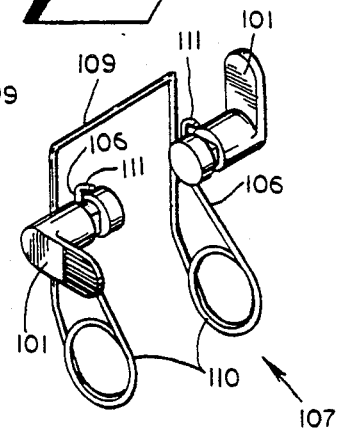
Fig. 10A

BOLT MECHANISM FOR FIRE ARM

CROSS-REFERENCE TO RELATED APPLICATION

This application is a division of Ser. No. 784,157 filed Oct. 4, 1985 and now U.S. Pat. No. 4,693,170; which in turn is a division of Ser. No. 639,526 filed Aug. 8,1984 and now U.S. Pat. No. 4,553,469; which in turn is a continuation of Ser. No. 336,328 filed Dec. 31, 1981 and now abandoned.

FIELD OF THE INVENTION

This invention relates in general to repeating firearms, and relates in particular to autoloading shotguns and other firearms.

BACKGROUND OF THE INVENTION

Past efforts to design improved, practical autoloading shotguns generally have been constrained by the effects of firing recoil, or by inadequately considering the effects of recoil when designing the gun. (The term "autoloading" is here used to denote a gun which, when fired, automatically ejects the spent shell and loads a fresh round from a magazine, and includes semi-automatic as well as full-automatic firing modes.) Although recoil affects any firearm to some degree, the relatively heavy recoil of shotguns is recognized by most shooters. Particularly in larger-gauge shotguns, recoil causes discomfort to the shooter and, in the case of autoloading shotguns, prevents effectively tracking a target with repeated fire, that is, for more than one round.

The undesirable effects of recoil are particularly troublesome when designing and using shotguns intended for full-automatic fire, or so-called assault shotguns. Law enforcement agencies and military applications have desired the close-range firepower and intimidating effects of a shotgun capable of selective full-auto firing, but the repeated recoil of, say, a 12-gauge shotgun firing full-auto makes such guns very difficult for most shooters to control.

The effects of recoil have caused other problems in past efforts to design shotguns capable of full-automatic firing. Such firearms require a substantial cartridge capacity in order to be effective, and increased cartridge capacity is obtained with either .a box magazine or drum magazine. Past efforts to design full-automatic shotguns using either box or drum magazines have generally been unreliable, due to the relatively high recoil of the conventional shotgun. As a shotgun equipped with a box or drum magazine kicks backwardly and rearwardly when fired, the inertia of shotgun shells in the magazine resists this movement. This inertia effect causes the shells to compress the magazine spring and move downwardly relative to the magazine feed lips which move rearwardly during firing, or put differently, the shells because of their inertia momentarily stay put in space while the shotgun and magazine suddenly move back and up due to recoil. This inertia effect takes place while the bolt assembly, having ejected the spent shell, is moving forward to chamber a fresh round from the magazine. The top round in the magazine may still be below the magazine feed lips due to the inertia effect of recoil, so that cartridge loading from the box or drum magazine is unreliable.

Past efforts to overcome the inertia effect on box and drum magazines have involved modifications to the magazine, but such modifications have generally been unsuccessful. Consequently, most autoloading shotguns (whether or not capable of full-auto firing), are equipped with tubular magazines. The limited cartridge capacity and relatively slow one-round-at-a-time reloading of tubular magazines makes these magazines an undesirable substitute for box or drum magazines, in autoloading shotguns designed or intended for law enforcement or combat applications.

SUMMARY OF THE INVENTION

Stated in general terms, the present firearm overcomes the foregoing and other problems of prior-art automatic shotguns by substantially reducing the recoil impulse. Consequently, the present firearm is more easily controlled by the shooter, and the above-described cartridge feeding problems are eliminated in autoloading shotguns in accordance with the present invention.

Stated somewhat more particularly, the firearm of the present invention is a gas-operated locked breech firearm having a long recoil path allowing the bolt and bolt carrier assembly to travel rearwardly a substantial distance beyond that required to extract a spent shell and load a fresh round. Rearward travel all the way to the buttplate of the firearm is possible, yielding a longer duration of recoil and thus a lower impulse. The gas piston rod is supported by a single guide rod which extends substantially the entire length of the firearm. This guide rod is secured to the buttplate at the rear of the firearm, and is rigidly connected at the front end to the barrel. The single guide rod passes through the gas piston, and the guide rod has a noncircular or radially assymmetrical cross-section slidably fitting a mating opening through the gas piston. The cross-section shape of the single guide rod thus angularly aligns and guides the bolt at all times when the bolt is unlocked and withdrawn from the breech of the firearm, including times when the bolt is entirely withdrawn from the receiver due to the long recoil stroke of the action. The gas piston rod is normally biased toward a full-forward position, whereat the bolt is chambered and locked, by an action spring extending substantially the entire length of the guide rod. Guns according to the present invention can be designed either for semiautomatic closed-bolt firing, or for open-bolt semiautomatic or full-auto selective firing; and can be designed for shotgun or for rifle ammunition.

Other novel features and aspects of the present invention, its construction and operation, become more apparent from the following description of preferred embodiments.

Accordingly, it is an object of the present invention to provide an improved firearm.

It is another object of the present invention to provide a firearm having substantially reduced recoil.

It is still another object of the present invention to provide an improved autoloading shotgun.

It is yet another object of the present invention to provide an autoloading shotgun having substantially reduced recoil, and capable of utilizing a box or drum magazine.

Other objects and advantages of the present invention will become more readily apparent from the following description thereof.

BRIEF DESCRIPTION OF DRAWING

FIG. 9 is a fragmentary sectioned elevation view of the buttplate.

FIG. 10 is a fragmentary elevation section view of the buttplate taken along line 10—10 of FIG. 3.

FIG. 10A is a pictorial view showing details of the rear stock catches.

FIG. 10B is an enlarged section view of a rear stock catch.

FIG. 32 is a fragmentary and partially sectioned elevation view showing details of the firing mechanism and bolt carrier assembly for a firearm according to an alternative disclosed embodiment of the present invention.

FIG. 34A is a fragmentary section view showing the forward end of the bolt and firing pin of the embodiment depicted in FIGS. 32–34, with the bolt forward end locked.

DESCRIPTION OF PREFERRED EMBODIMENTS

Figures 1A, 1B:
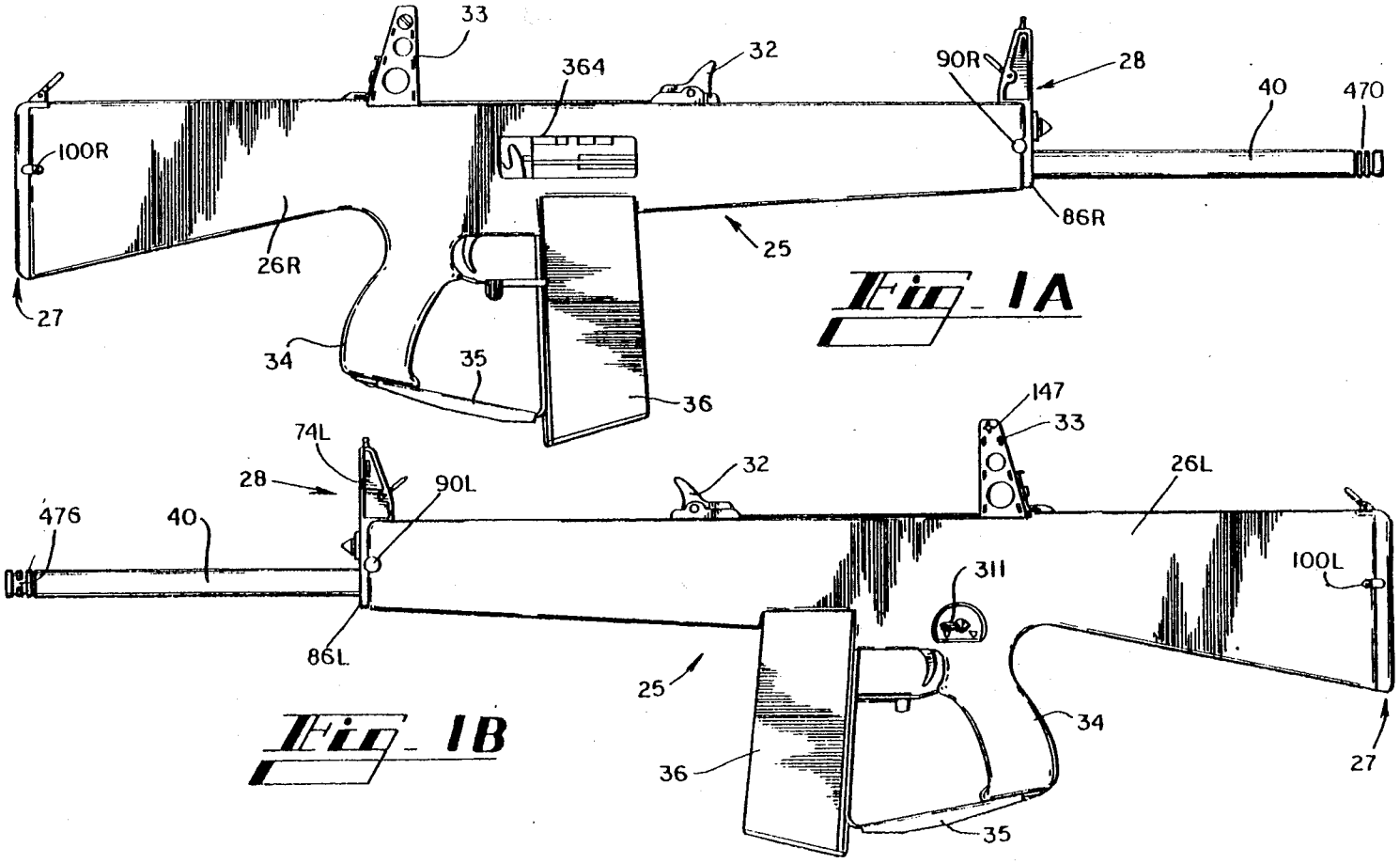
FIGS. 1A and 1B are elevation views respectively showing the right side and left side of a firearm according to a disclosed first embodiment of the present invention.
Figure 2:
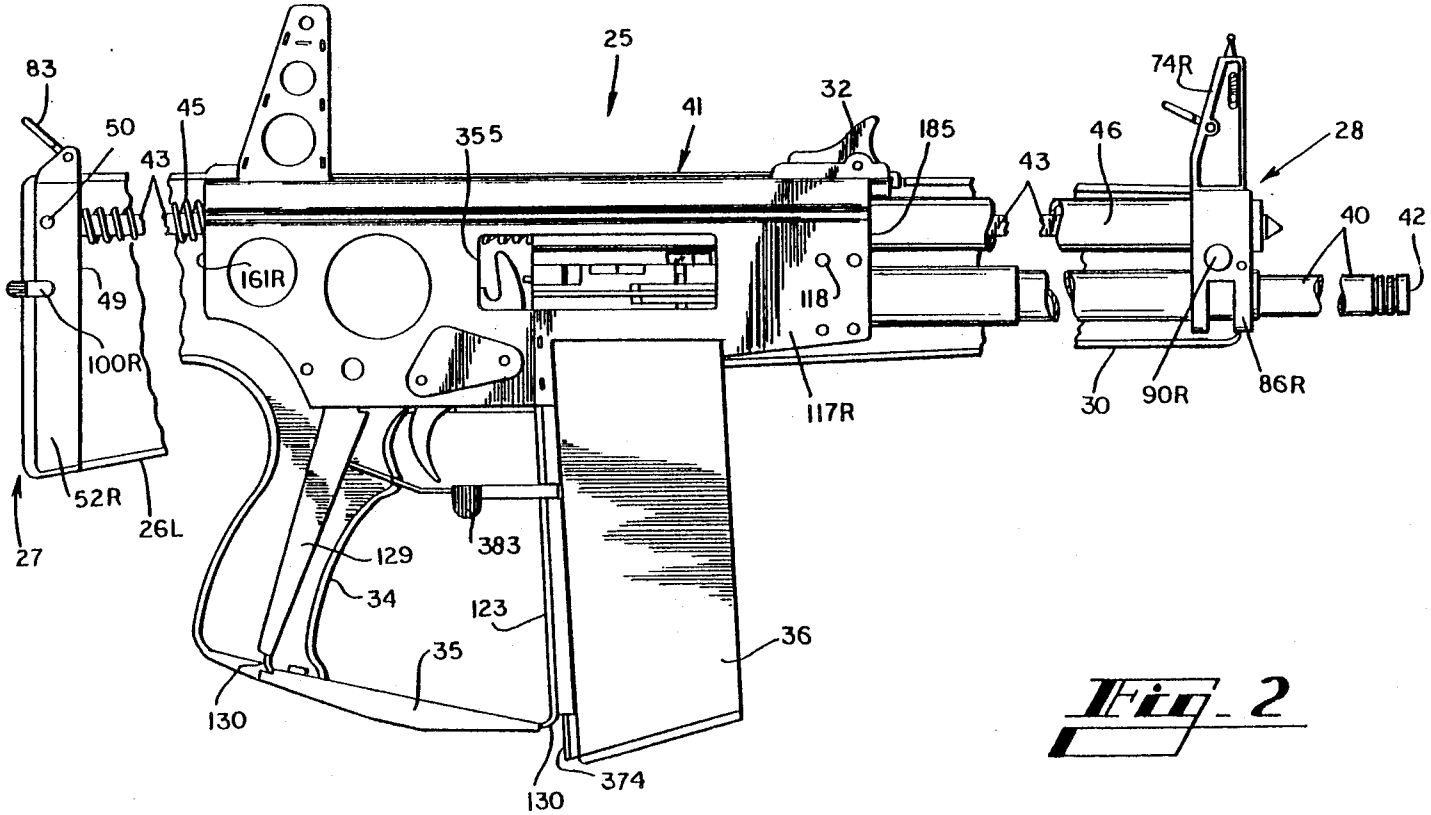
FIG. 2 is a plan view of the firearm shown in FIG. 1A, shown partially broken-away and with the right stock shell removed for illustrative purposes.

Turning first to FIGS. 1A, 1B, and 2, there is shown generally at 25 a shotgun according to a first preferred embodiment of the present invention. This shotgun 25 is a gas-operated locked breech gun chambered to fire a 12-gauge round, and is configured to receive interchangably either a box magazine 36 or a drum magazine for feeding rounds. However, it will become apparent from the following description that most if not all features of the present invention are not limited to shotguns, but alternatively may be used in rifled firearms to reduce recoil and provide other advantageous results.

The shotgun 25 has a stock comprised of hollow stock shells 26L and 26R respectively enclosing the left and right sides of the gun. These stock shells 26L and 26R, which extend from the buttplate 27 to the gas cylinder/front sight 28 at the front of the gun, are clamshell-like members which may be molded from a suitable material such s glass-reinforced plastic or the like. The stock shells 26L and 26R join each other along parting lines 29 (FIG. 17) and 30 (FIG. 21A) on the top and bottom, respectively, of the gun. The stock shells define an elongated slot 31 on the top of the gun to receive the charging handle 32 and the rear sight 33; the stock shells are molded to define a pistol grip 34 on the underside of the gun, with the structural grip bracket 35 extending forwardly from the pistol grip toward the box magazine 36. Each stock shell 26L and 26R is held in place on the gun 25 by six stock catches, two each at the buttplate 27 and the gas cylinder/front sight 28, another associated with the rear sight 33, and the fourth associated with the grip bracket 35. These stock catches are discussed below in greater detail, but it should now be apparent that the stock shells are held in place on the gun 25 without fasteners extending through the stock shells intermediate the front and back ends, and without bands or other members encircling the stock shells.

Figure 3:
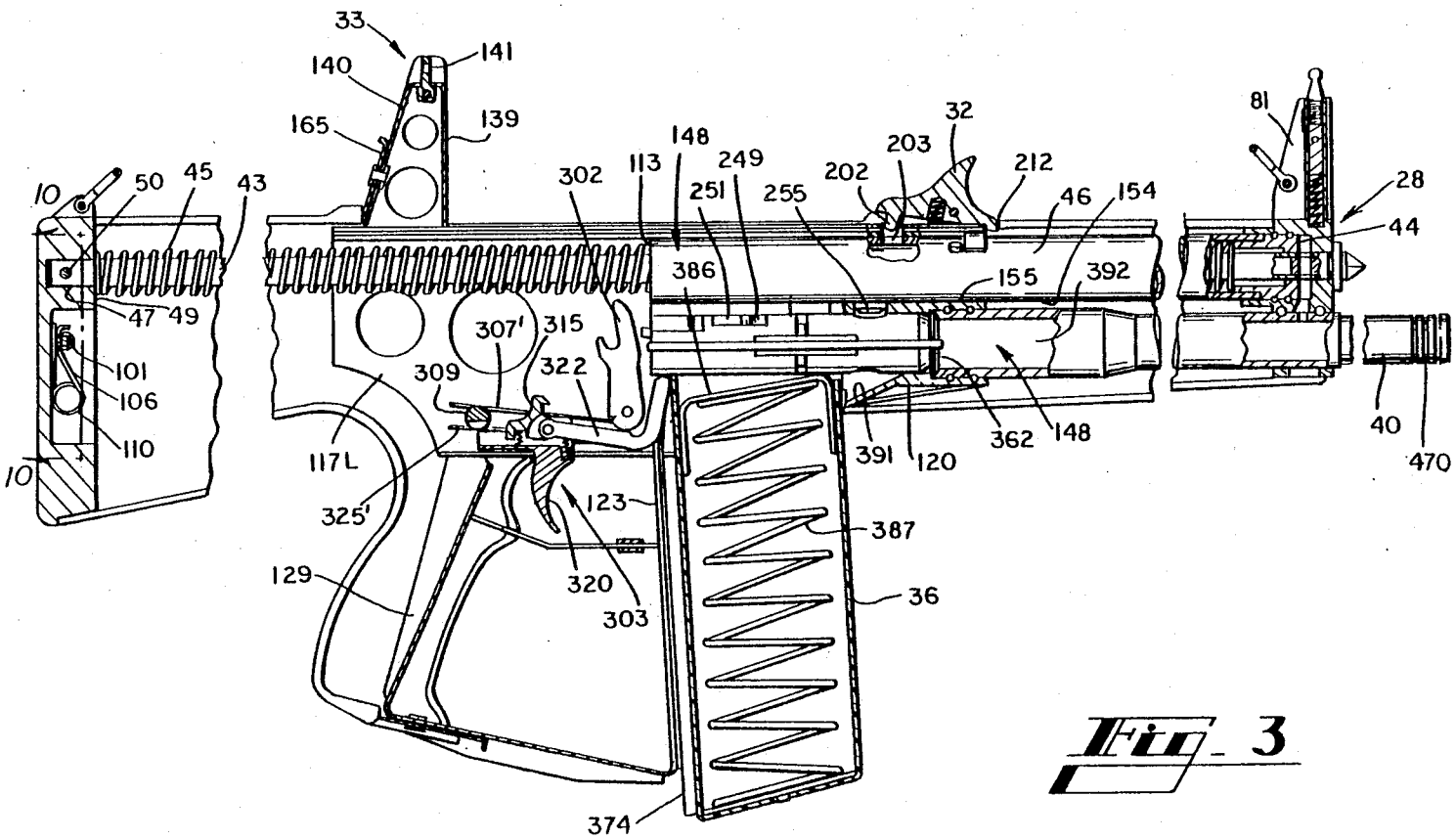
FIG. 3 is a right elevation view of the firearm shown in FIG. 2, with the right receiver plate removed and portions of the firearm shown broken away and sectioned for illustrative purposes.

Turning now to FIGS. 2 and 3, it is seen that the gun 25 includes a barrel 40 retained within the receiver section 41 of the gun and extending forwardly to the muzzle 42 extending a distance in front of the gas cylinder/front sight 28. Several annular grooves are formed around the barrel adjacent the muzzle 42, to facilitate securing accessories to the barrel as detailed below. Mounted above the barrel 40 is the gas piston guide rod 43, in the disclosed embodiments being a hollow rod of rectangular cross-section extending substantially the entire length of the gun from the buttplate 27 to the gas cylinder/front sight 28.

The gas piston 44 (FIGS. 3 and 5), and the gas piston rod 46 attached thereto, are supported by the guide rod 43 for reciprocal movement thereon between the gas cylinder/front sight 28 and the buttplate 27. The action spring 45, comprising a compression coil spring loosely fitting over the guide rod 43, urges the gas piston 44 and piston rod 46 to the full-forward position (best shown in FIGS. 3 and 5) within the gas cylinder 28. The action spring 45 at its rear end contacts the buttplate 27, and extends forwardly to enter the hollow gas piston rod and engage the gas piston 44 adjacent the front end of the gas piston rod. The action spring 45 is a loose fit over the guide rod 43 and within the hollow piston rod 45.

The gas piston rod 46 slides through a rectangular hole **44*a* (FIGS. 5 and 11C) in the base of the gas piston, and the complementary rectangular shapes of the gas piston hole and the guide rod 43 maintains the gas piston (including the piston rod 46 and attached bolt carrier 149**) in predetermined angular alignment as the gas piston reciprocates along the guide rod. It should be understood that the guide rod and piston hole can alternatively have any other appropriate nonuniform cross-section shape which maintains the desired angular alignment.

The gun 25 is held in assembly by an arrangement including the rigid guide rod 43, together with the stock shells 26L and 26R. As best seen in FIGS. 3 and 10, the rear end 47 of the guide rod 43 fits within the complementary opening 48 formed in the forward face 49 of the buttplate 27. A retaining pin 50 extends through aligned lateral pin-receiving openings in the buttplate face on each side of the guide rod opening 48, and through an aligned lateral opening near the rear end 47 of the guide rod, securing the guide rod to the buttplate 27. The ends of the guide rod retaining pin 50 are flush or slightly recessed below the stock shell-receiving right surface 52R (FIG. 10) on the right side of the buttplate 27, and the corresponding surface on the left side of the buttplate. It will be understood that the stock shells 26L and 26R keep the retaining pin 50 in place within the buttplate 27, so long as the stock shells remain attached to the buttplate. Details of a latch mechanism for removably securing the stock shells to the buttplate are described below.

Figure 5:
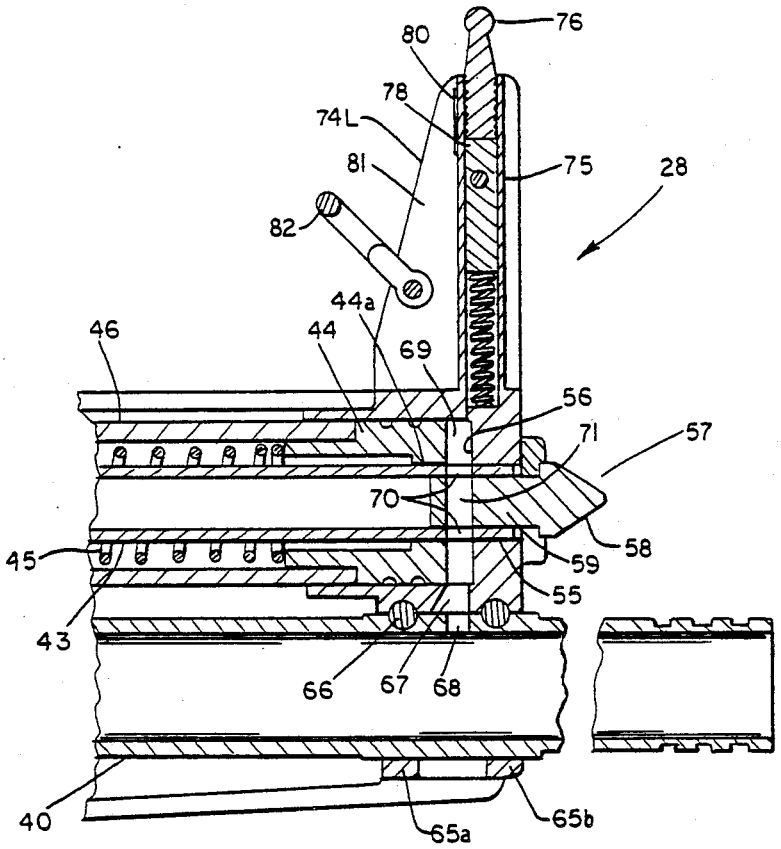
FIG. 5 is an enlarge fragmentary section view showing details of the gas cylinder, gas piston, and related parts at the forward end of the disclosed firearm.

Referring to FIGS. 3 and 5, the forward end 55 of the guide rod 43 is snugly yet slidably received in an opening of mating cross-section in the vertically-positioned base 56 of the gas cylinder/front sight 28. The forward end 55 of the guide rod 43 is fitted with a guide rod tip 57, having a pyramidal forward end 58. The frontal profile of the pyramidal forward end 58 allows passage through the guide rod-receiving opening through the base 56 of the gas cylinder, and the guide rod tip 57 includes a shank 59, behind the pyramidal forward end, fitted a distance into the forward end 55 of the guide rod 43. The shank 59 is secured within the guide rod 43 by brazing or the like, with the pyramidal forward end 58 spaced a distance in front of the forward end of the guide rod to provide a channel **59*a* (FIG. 6) of reduced cross-section dimension for receiving the guide rod retainer 60**.

Figure 6:
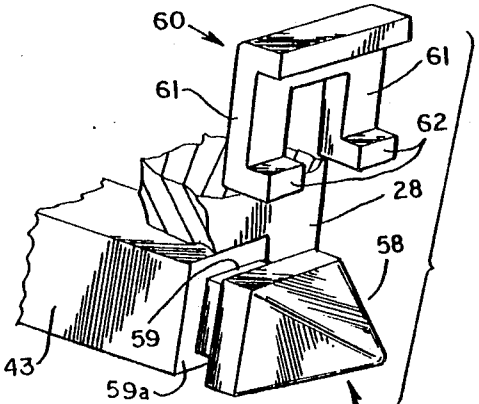
FIG. 6 is a pictorial view showing the guide rod tip and guide rod retainer separated from the gun and exploded relative to each other.

The retainer 60 is a solid member having an inverted-U shape as best shown in FIG. 6, including a pair of legs 61 spaced apart to just slidingly fit over the reduced-area shank portion 59 between the front end 55 of the guide rod 43 and the pyramidal forward end 58 of the guide rod tip 57. The lower ends of the legs 61 are turned forwardly to form the lugs 62 which fit snugly below the base of the pyramidal forward end 58 of the guide rod tip in assembly, FIG. 5, thus holding the guide rod retainer 60 in place.

Figure 12:
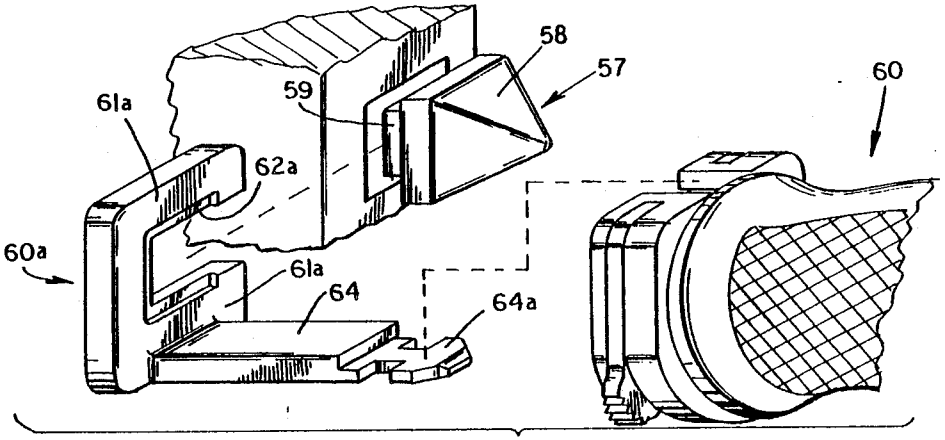
FIG. 12 is an exploded pictorial view showing a modified guide rod retainer, including a bayonet attachment.

The guide rod retainer 60 may alternatively be held in place by the alternative guide rod retainer **60*a*, FIG. 12, which also functions to retain a conventional bayonet 61 on the forward end of the gun barrel. The alternative guide rod retainer 60*a* slides over the shank portion 59 of the guide rod tip 57 from the right side, with the two legs 61*a* spaced apart for that purpose. Each leg 61*a* includes a recessed forward portion 62*a* into which the guide rod tip fits, to secure the guide rod retainer 60*a* in assembly. A finger 64 extends forwardly from the lower of legs 60*a*, and a notched member 64*a* projects outwardly from the end of the finger. It will be understood that the notched end 64*a* should be appropriately configured to engage the handle of a particular bayonet 61**, thereby securing the bayonet above the barrel of the gun.

The gas cylinder/front sight 28 is rigidly secured to the barrel 40 of the gun, and supports the guide rod 43 and the front ends of the stock shells in assembly. The gas cylinder/front sight preferably constitutes a unitary part, having at the lower end a pair of hoops **65*a* and 65*b* through which the forward end of the barrel 40 extends. Pins 66 extend through holes in the hoops 65*a*, 65*b* and through aligned grooves formed on a land around the barrel within the hoops, rigidly interlocking the barrel with the gas cylinder/front sight 28. The region above the barrel 40 between the hoops 65*a* and 65*b* defines the gas collection chamber 67, receiving gas from the barrel through one or more circumferentially-spaced gas ports 68 in the barrel immediately below the gas collection chamber. As is apparent from FIG. 5, the upper end of the gas collection chamber 67 directly communicates with the gas cylinder 69 at the base of the gas piston 44**.

Because the guide rod 43 extends through the gas cylinder 69, a pair of aligned gas holes 70 are formed in the guide rod substantially in alignment with the opening of the gas collection chamber 67 into the gas cylinder. The gas holes 70 in the guide rod are aligned with the gas hole 71 in the shank 59 of the guide rod tip 57. The gas holes 70 and 71 through the forward end of the guide rod 43 enhance the flow of gas into and throughout the cylinder 69, enabling gas to circulate through the gas holes and act on the entire area of the gas piston 44 without first having to flow around the guide rod 43 extending through the piston.

Extending upwardly at the forward side of the gas cylinder/front sight 28 is the front sight post 75, defining a hollow upwardly-extending cylindrical chamber open at its upper end and threaded a distance downwardly therefrom. A patch of luminous material 80 is affixed to the back of the front sight post, providing a front night sight which cooperates with the rear night sight (FIG. 13) described below. The front sight bead 76 threads into the opening of the front sight post, and terminates at an upper beaded end providing the front sight of the gun. The lower end of the front sight bead 76 is notched to receive the tang 78 of the bead lock 77 slidably received within the hollow front sight post 75. A compression spring 79 within the front sight post urges the bead lock 77 upwardly to engage and prevent unwanted rotation of the front sight bead 76. To adjust elevation of the front sight bead 76, the bead lock 77 is held downwardly by grasping the bead lock pin 79 extending through the bead lock, and through mating slots in the sides of the front sight post 75, thereby freeing the front sight bead for rotation in either direction.

A pair of side walls 74L (FIGS. 1B and 5), 74R (FIG. 2) flank the front sight post 75, and the front sling swivel 82 is attached between the side walls. The rear sling swivel 83, FIGS. 2 and 3, is attached to a lug formed at the top of the buttplate 27. A groove 81 is formed between the side walls 74L, 74R behind the front sight post 75, and a patch of luminous material 80 is affixed to the back of the front sight post within the groove. The luminous material 80 forms a front night sight which cooperates with the rear night sight described below. The side walls 74L, 74R extend behind the luminous material 80, protecting the luminous material and hiding it from side view.

The forward end of each stock shell 26R and 26L fits snugly alongside the sides 86L (FIG. 1B) and 86R (FIG. 1A, FIG. 7A) of the gas cylinder/front sight 28. The inside of each stock shell is inwardly scalloped at its front end to form a depression, as shown at 87 in FIG. 7A, which allows the stock shell front end to fit snugly over the corresponding side of the gas cylinder/front sight. The stock shell 26R has an enlarged portion 88 immediately behind the scalloped depression 87, providing a shoulder which rests against the front edge 89 of the gas cylinder.

Figure 7B:
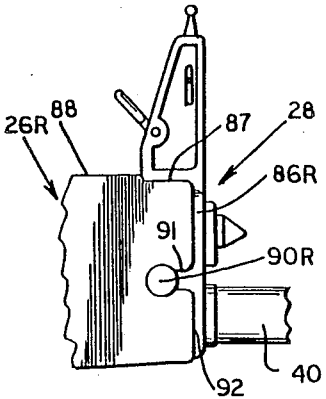
FIGS. 7A and 7B are fragmentary elevation views showing the front end of the disclosed firearm, with the right stock shell respectively removed from and attached to the gas cylinder/front sight.
Figure 7A:
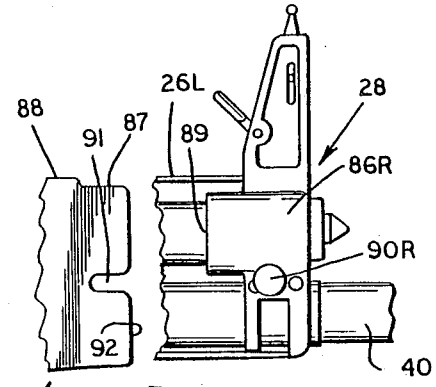

A pair of mushroom-headed studs 90L (FIG. 1B) and 90R (FIGS. 1A, 7A, and 7B) extend outwardly from the corresponding sides 86L and 86R of the gas cylinder/-front sight 28. Each stud engages a corresponding slot 91 extending rearwardly from the forward edge 92 of the stock shell half. It will be understood that the enlarged head of each stud 90L and 90R overlaps the sides of the slots 91, as illustrated in FIG. 7B, thereby securely retaining the front ends of the stock shells in place on the gas cylinder/front sight 28.

Figure 8B:
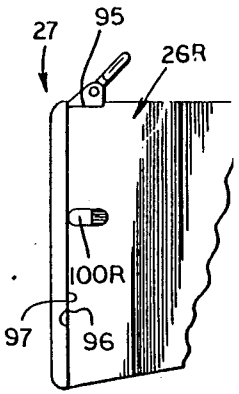
FIGS. 8A and 8B are fragmentary elevation views showing the back end of the disclosed firearm, showing the right stock shell respectively detached from and attached to the buttplate.
Figure 8A:
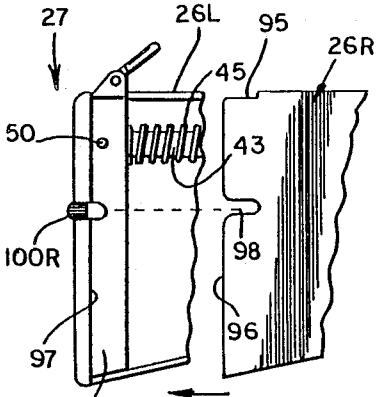

The back end of each stock shell 26L and 26R is removably secured to the buttplate 27 against the stock receiving right surface 52R and the corresponding left surface, as best shown in FIGS. 8A and 10. The back end 96 of each stock shell is inwardly scalloped to provide the depression 95, which allows the stock shell to fit snugly against the buttplate stock receiving surfaces with the stock shell back edge abutting the ledge 97 extending outwardly from the buttplate surface. The ledge 97 thus covers the back edge 96 of each stock shell and provides a relatively uniform and smooth appearance to the butt end of the gun.

A slot 98 extends inwardly from the back edge 96 of each stock shell, and each slot 98 receives the shaft 99 of corresponding rear stock latches 100L, 100R mounted on opposite sides of the buttplate 27. The stock latches are shown in FIGS. 10 and 10A in greater detail, with the typical latch 100R having a stock-engaging finger 101 extending radially outwardly from the outer end of the shaft 99, standing off a distance from the stock receiving surface (FIG. 10) 52R of the buttplate. The shaft 99 rotatably extends through an opening in the surface 52R, with the inner end of each stock latch shaft located in the recess 102 in the forward face 49 of the buttplate below the guide rod receiving opening 43. A circumferential groove 105 is formed around the inner end of each shaft 99, and the free ends 106 of the stock catch spring 107 engage the respective grooves 105, 105 as best shown in FIG. 10A. The spring ends in the grooves 105 prevent the stock catches 100L, 100R from falling out of the buttplate 27, and each groove is positioned along the length of the shaft 99 so as to locate the catch finger 101 a predetermined standoff distance outwardly from the stock receiving surfaces. This standoff distance is approximately the thickness of the stock shell at its back edge 96, so that the stock shell is securely held in place on the buttplate when the slot 98 engages the shaft 99 and the catch finger 101 is rotated to the forwardly-pointing position shown in FIG. 8B.

A pair of flats 108, 108' (FIG. 10B) are formed 180 degrees apart in each groove 105. These flats are positioned to engage an end 106 of the stock catch spring 107 so as to detent the stock catch either in the engaged position shown in FIG. 10A, or in the disengaged position with the catch finger 101 extending rearwardly to release the back edge 106 of the stock shell as shown in FIG. 8A. The stock catch spring 107 thus performs several functions, namely, retaining the stock catches 100L, 100R in place, detenting the stock catches, and positioning each stock catch for the desired standoff between the fingers 101 and the respective buttplate surfaces 52L, 52R.

The spring 107 includes a U-shaped body 109 lying flush against the back wall of the recess 102 in the buttplate, with torsion-wound coils 110 at the bottom of the spring body below the shafts 99 of each stock catch. The spring ends 106 extend upwardly from the coils 110 to engage the grooves 105 along the back of the shafts 99, and terminate in fingers 111 bent forwardly and above the shafts to keep the spring from sliding downwardly within the recess 102 and slipping out of the grooves 105.

Figure 11C:
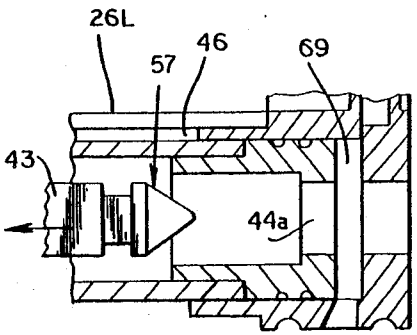
FIGS. 11A, 11B, and 11C are fragmentary elevation sectioned views of the firearm forward end, showing the disassembly sequence.
Figure 11B:
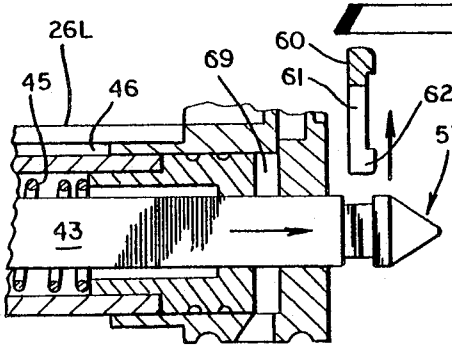
Figure 11A:
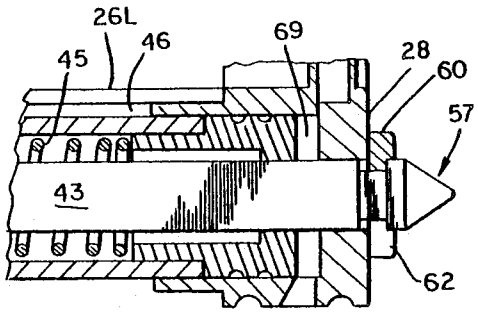

The disassembly of the gun 25 is now discussed with reference to FIGS. 11A–11C, to show how the stock shells 26L, 26R cooperate with other parts to hold the gun in assembly. Assuming the gun 25 is assembled as shown in FIGS. 1A and 1B, the stock shells engage the stock catches 100L, 100R at the buttplate, and also engage the studs 90L, 90R at the gas cylinder/front sight 28. The stock shells thus prevent the buttplate and the gas cylinder/front sight from moving together.

(Each stock shell is also secured to the gun by the top and bottom stock catches, discussed below.) The horseshoe-shaped guide rod retainer 60 prevents the guide rod 43 from moving rearwardly through the gas cylinder/front sight at this time, and so the gun 25 is maintained in its assembled configuration.

The gun 25 is disassembled by initially rotating the rear stock catches 100L, 100R to the unlatched position shown in FIG. 8A so the fingers 101 no longer extend over the stock halves, and by releasing the top and bottom stock catches. The back edge 96 of each stock half may now be laterally withdrawn from the stock receiving surfaces 52L and 52R of the buttplate 27, permitting each stock half to be pulled rearwardly relative to the gas cylinder/front sight 28. The front end 92 of each stock half is thus withdrawn from respective studs 90L, 90R of the gas cylinder/front sight, reversing the assembly step depicted in FIG. 7A.

With the stock halves 26L and 26R removed from the gun, the buttplate 27 and attached guide rod 43 may now be moved forwardly relative to the gas cylinder/-front sight 28. This forward movement slightly compresses the action spring 45, and also moves the guide rod 43 from the normal assembled position (FIG. 11A) to the position shown in FIG. 11B. Forward movement of the guide rod tip 57 and the guide rod retainer 60 relative to the gas cylinder/front sight 28 frees the retainer, which may now be removed from the shank 59 of the tip by lifting upwardly as illustrated in FIG. 11B. With the retainer 60 removed from the guide rod 43, the guide rod now may be separated from the gas cylinder/-front sight 28 by moving the guide rod rearwardly as illustrated in FIG. 11C, wherein the guide rod including tip 57 is withdrawn rearwardly through the base 56 of the gas cylinder 69 and through the coaxial opening 44' in the gas piston 44. Continued rearward movement entirely withdraws the guide rod 43 from the gas piston 44 and from the open rear end 113 (FIG. 3) of the gas piston rod 46 attached to the gas piston, thus freeing the action spring 45 for removal from the guide rod. The entire gas piston rod, which forms part of the bolt carrier assembly 148 described below, can now be removed, as becomes clear from the following description of the gun 25.

The receiver section 41 and related components are now discussed with particular reference to FIGS. 2, 3, 13, and 14. The receiver section 41 includes a left receiver plate 117L and a right receiver plate 117R, each preferably formed of sheet metal. The receiver plates are held in assembly at their forward ends by the rivets 118 secured in holes 119 in the receiver plates. The rivets 118 pass through mating holes in the barrel extension 120, and engage transverse grooves at the top and bottom of the barrel 40, which extends outwardly from the front of the barrel extension (FIG. 32). The barrel and barrel extension, together with the forward ends of the receiver plates 117L and 117R, thus are secured together by the rivets 118.

Spacing between the receiver plates is maintained on the underside by the upper end of the magazine bracket 123, which extends downwardly from the receiver section and supports the cartridge magazine 36. Pairs of tabs 125 extend laterally from each side of the magazine bracket 123 at its upper end, and the tabs engage corresponding pairs of slots 126 in each receiver plate 117L, 117R, immediately behind the magazine-receiving recess 127 formed in the underside of each receiver plate. A vertical slot 128 is formed in the upper end of the magazine bracket 123 for a purpose discussed below.

Figure 4:
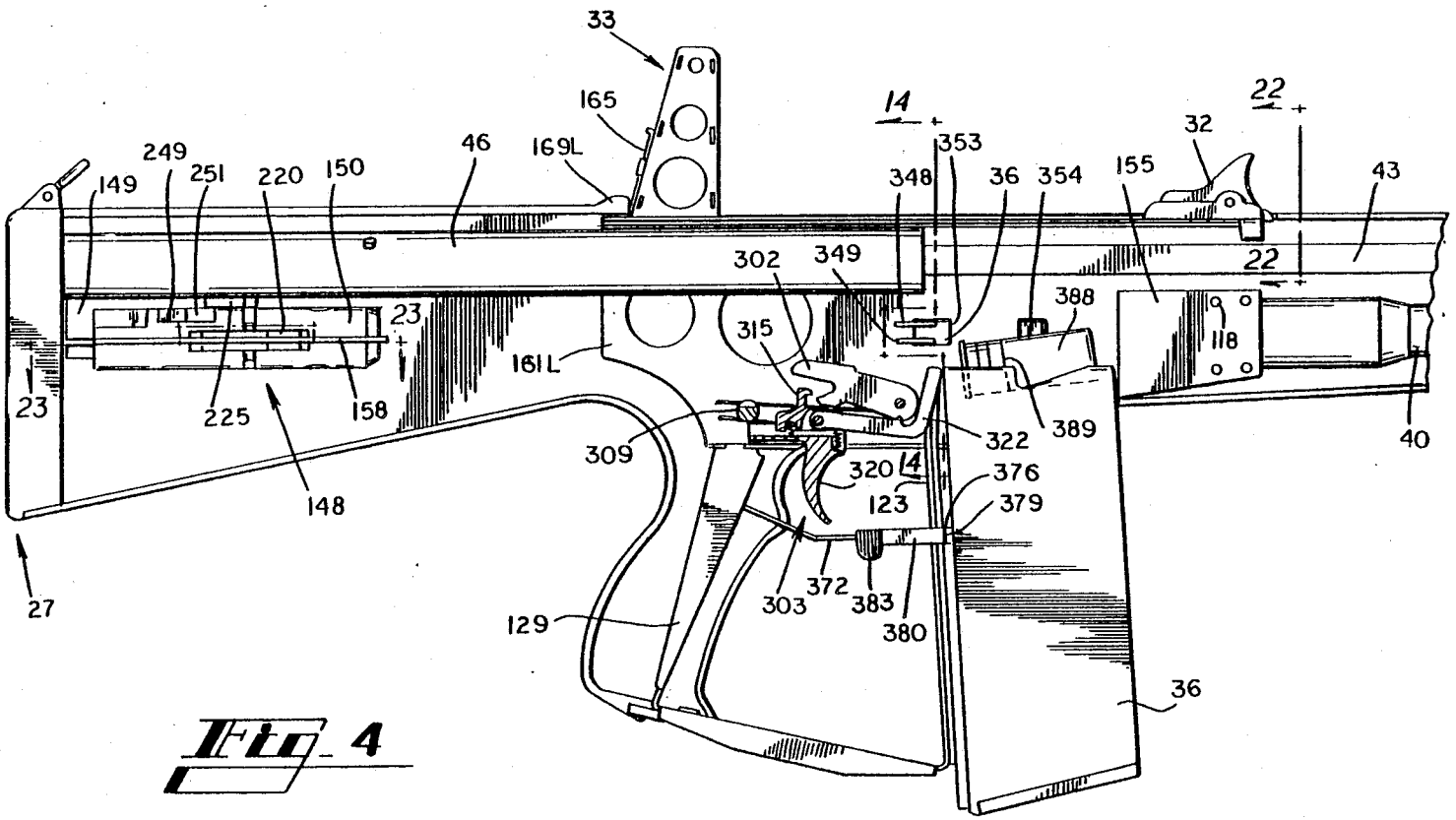
FIG. 4 is a right elevation view showing a rear portion of the firearm depicted in FIG. 3, with the bolt carrier assembly shown in full-recoil position.

The magazine bracket 123 is part of a unitary magazine bracket assembly including the grip bracket 35 (FIGS. 2 and 4) extending rearwardly from the bottom of the magazine bracket to fit within the pistol grip portion 34 formed by the stock shells, and the rear bracket leg 129 extending upwardly from the back of the grip bracket. The magazine bracket assembly including the magazine bracket 123, the grip bracket 35, and the rear bracket leg 129, preferably is a unitary part formed by stamping and bending to form the channel-shaped components, with sidewall portions cut away at 130 to facilitate bending. As best seen in FIGS. 2 and 4, the rear bracket leg 129 is entirely concealed within the pistol grip 34 of the assembled gun.

A pair of upwardly-extending tabs 133 (FIG. 13) is formed at the upper end of the rear bracket leg 129. These tabs engage mating slots 134 formed in the inwardly-turned flange 135 at the underside of each receiver plate. The interconnection of the tabs 133 and slots 134 helps maintain the spacing between the receiver plates, as well as the overall structural integrity of the receiver section 41. It will be understood that the several mating tabs and slots in interconnecting stamped portions of the receiver section may be secured together by suitable techniques such as staking or the like.

The rear sight 33 is shown generally in FIG. 1A, and includes left and right posts 138L and 138R (FIG. 13) extending upwardly from the tops of the respective receiver plates 117L and 117R. The rear sight posts 138L, 138R are integral with the respective receiver plates, each being a suitably formed and bent extension of the unitary sheet metal member making up the receiver plate. A front spacer 139 and a rear spacer 140 are retained between the rear sight posts 138L and 138R by tabs and slots. The upper ends of the spacers 139 and 140 face inwardly toward each other, and define a gap at the upper ends of the sight posts to receive the rear sight element 141. This rear sight element is supported between the rear sight posts 138L, 138R by the rear sight screw 142, extending transversely through the posts and having a threaded shank engaging a mating transverse opening in the rear sight element 141. A compression spring 142 fits between the head of the rear sight screw 142 and the right sight post 138R, to bias the screw and the rear sight element 141. A pin 145 (FIG. 17) extends through the tail 147 of the rear sight screw outside the left rear sight post 138L, and the pin engages one of the two crossed detents 147 formed in the outside of the left rear sight post. The transverse position of the rear sight element 141 between the posts 138L, 138R can be adjusted by turning the rear sight screw 142, thus providing a windage adjustment for the rear sight, and the pin 145/detents 147 form a click-stop for each quarter-turn of the rear sight screw. It will also be understood that the construction of the rear sight 138 rigidly interconnects the upper back ends of the receiver plates 117L, 117R, further defining the spacing between the receiver plates.

An annular ring 144 of luminous material is affixed to the rear spacer 140 immediately below the rear sight element, providing a rear night sight aligned with the front night sight 80. The back edges of the rear sight posts 138L, 138R extend behind the ring 140, protecting that ring and hiding it from side view.

A top stock catch 165 is slidably mounted on the backwardly-facing surface of the rear spacer 140, between the posts 138L and 138R of the rear sight. An elongated slot 166 longitudinally extends along part of the top stock catch 165, and a detent fastener 167 extends through the slot to engage the underlying rear spacer 140. The detent fastener 167 is urged downwardly against the periphery of the slot 166, perferably by means of a spring-loaded washer such as a tru-arc washer or the like on the inner end of the detent fastener contacting the underside of the rear spacer, so as to engage the enlarged upper end of slot 166 for locking the catch 165 in the lowermost stock-engaging position. This arrangement may be similar to corresponding features of the bottom stock catch, described below with reference to FIGS. 21A and 21B. A notch 168 is formed at the outwardly-turned lower end of the top stock catch 165, and this notch engages the upturned locking tabs 169L, 169R respectively formed on the stock shells 26L and 26R adjacent the top parting line 29, FIG. 17. The notch 168 in the lower end of the top stock catch 165 engages and holds together the locking tabs 169L, 169R when the top stock catch is in the lowermost position permitted by the slot 166. However, when the top stock catch is moved to the upper position shown in FIG. 13, the notch 168 is withdrawn from the locking tabs, permitting removal of the stock shells as previously described.

Figure 21B:
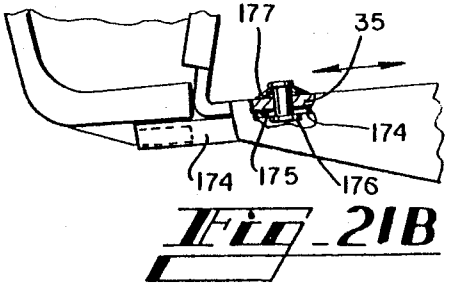
FIG. 21B is a fragmentary and partially-sectioned elevation view of the bottom stock lock shown in FIG. 21A.
Figure 21A:
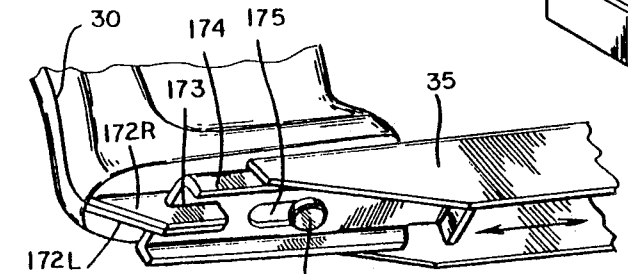
FIG. 21A is a fragmentary pictorial view taken from the underside of the grip bracket, showing details of the bottom stock lock.

Another pair of locking tabs 172L, 172R is formed on the bottom of the stock shells behind the grip bracket 35, as best shown in FIGS. 21A and 21B. These bottom locking tabs 172L, 172R are selectably engaged by a notch 173 formed in the back end of the channel-shaped bottom stock catch 174 which slidably fits within the downwardly-facing channel member making up the grip bracket 35. A slot 175 is formed in the bottom stock catch, and a detent fastener 176 extends through that slot and through a mating hole in the grip bracket 35, FIG. 21B. A spring-loaded washer 177 engages the inner end of the detent fastener 176, resiliently urging the detent fastener and the bottom stock catch 174 into engagement with the underside of the grip bracket 35. The head of the detent fastener 176 is beveled on its underside, providing a detent engagement with the enlarged forward end (same as the upper end of slot 166 in the top stock catch 165) of the slot 175 and thus detenting the bottom stock catch 174 in the rearward position engaging the locking tabs 172L, 172R, FIG. 21A.

The bottom stock catch 174 and the top stock catch 165, together with the locking stubs 90L, 90R at the front of the gun and the rear stock catches 100L, 100R, provide an eight-point engagement of the stock shells on the gun. The stock shells thus are held in assembly on the gun without any bolt or other fastener passing through the gun or encircling the gun to hold together the stock shells, and the stock shells are easily removable from the gun without requiring any takedown tools.

Figure 13:
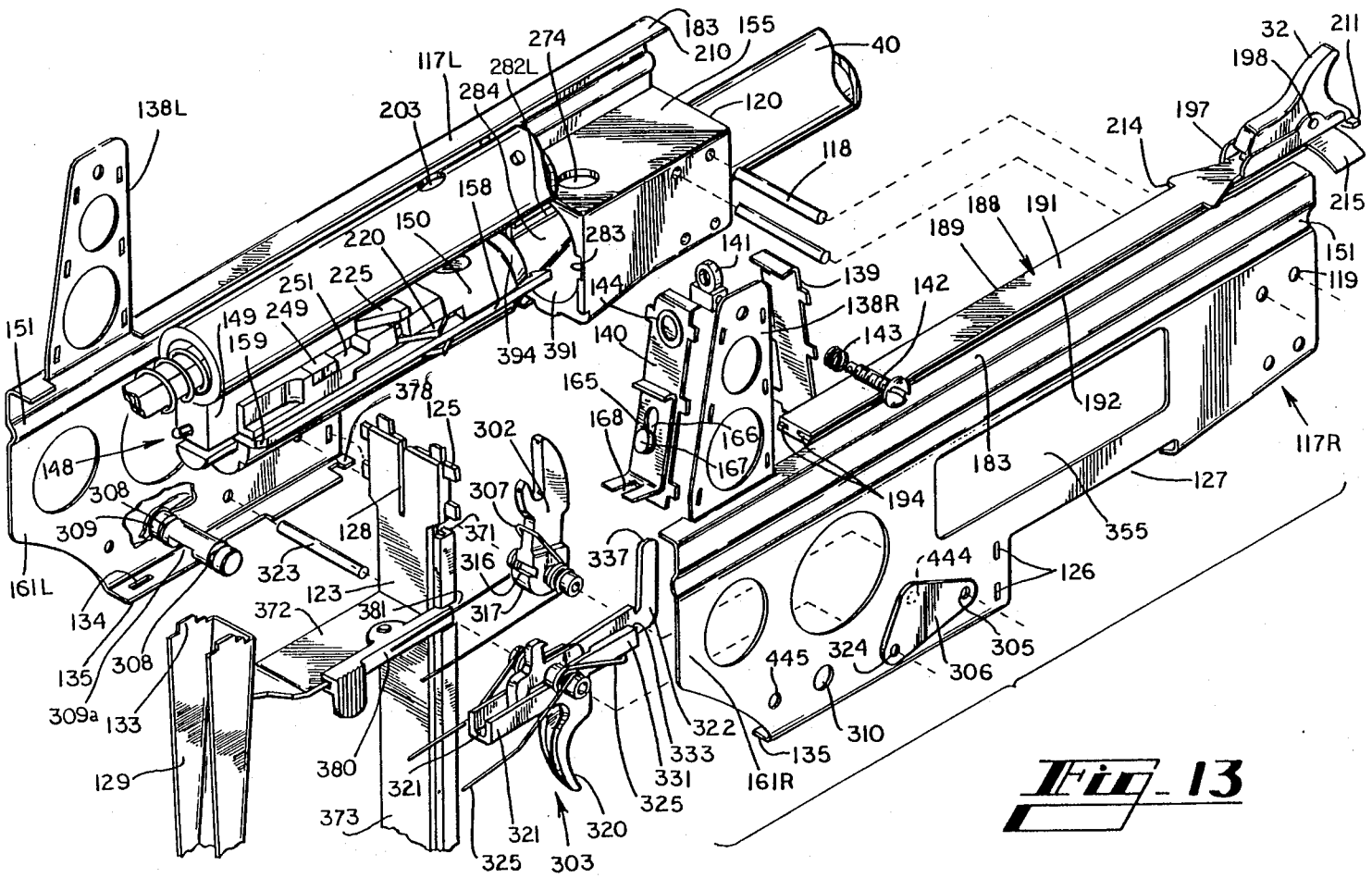
FIG. 13 is a partially-exploded view showing details of the receiver section of said firearm.
Figure 13:
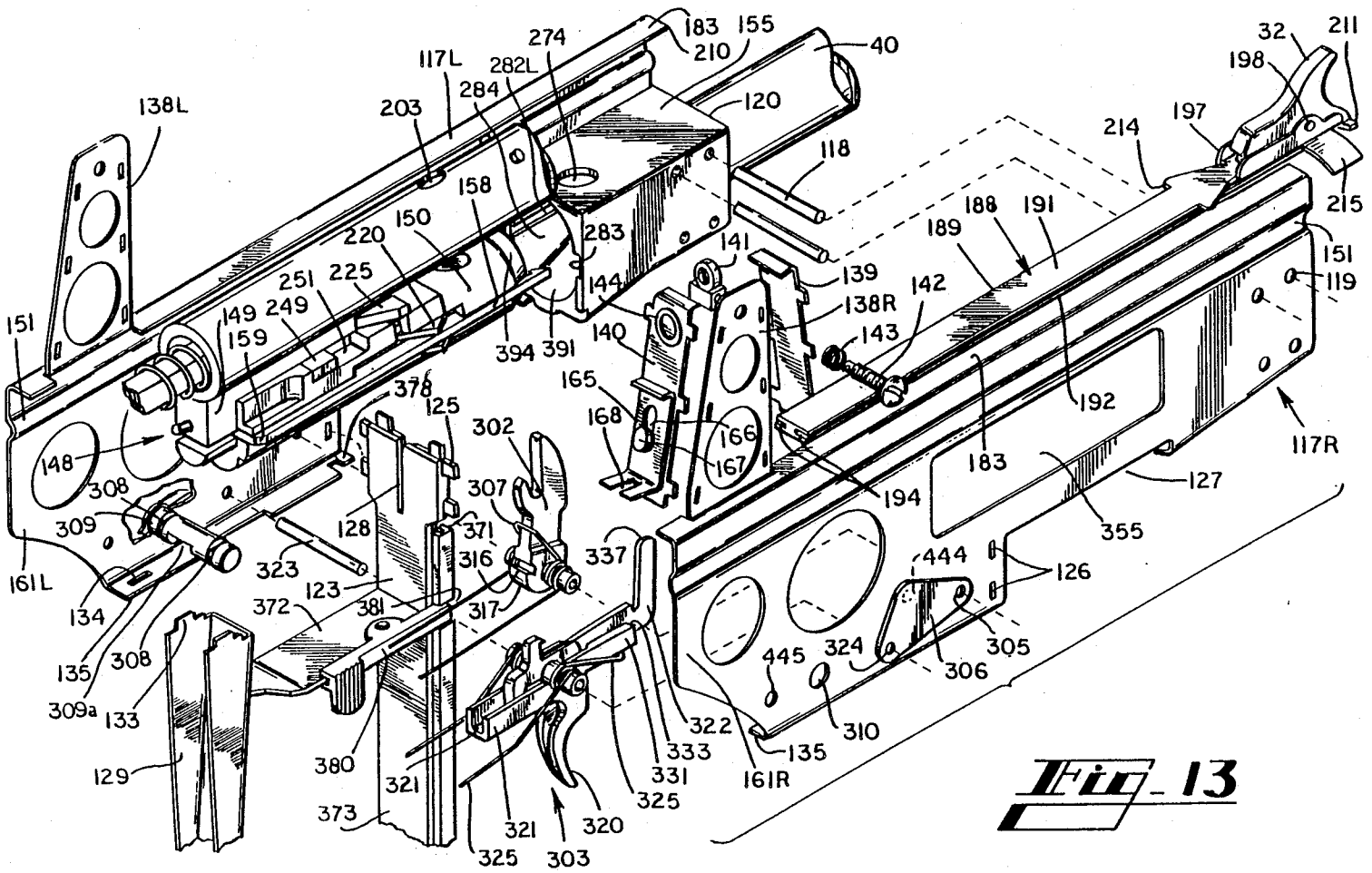
Figure 14:
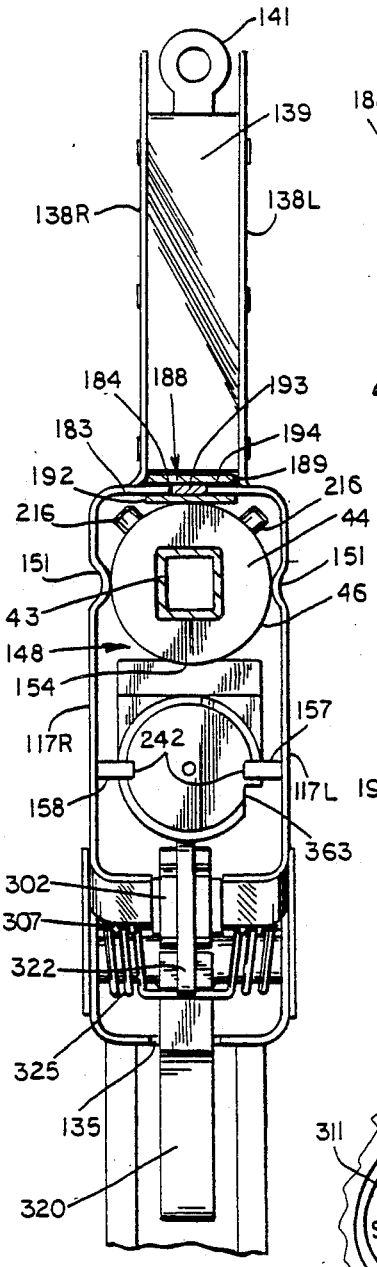
FIG. 14 is a section view of the assembled receiver section, taken along line 14—14 of FIG. 4.

The spaced-apart receiver plates 117L, 117R receive and guide the bolt carrier assembly 148, as best shown in FIGS. 13 and 14. The bolt carrier assembly includes the gas piston 44 and piston rod 46, the bolt carrier 149 secured to the bottom of the piston rod at rear end 113, and the bolt 150, as described below in greater detail. A ridge 151 is formed along the entire length of each receiver plate 117L and 117R and the ridges extend substantially alongside and parallel to the guide rod 43. The lateral spacing within the receiver plates between the two ridges 151 provides sliding clearance of the diameter of the piston rod 44, as best seen in FIG. 14, so that the piston rod (and thus the entire bolt carrier assembly 148) is guided on either side for reciprocal movement along the guide rod 43.

The gas piston rod 46, at its underside 154 when assembled in the gun, slides along the top surface 155 of the barrel extension 120. This sliding contact between the barrel extension and the piston rod (FIG. 3) provides bottom support and guidance for the bolt carrier assembly 148, except when the bolt carrier assembly is in full-recoil position as shown in FIG. 4.

Figure 20:
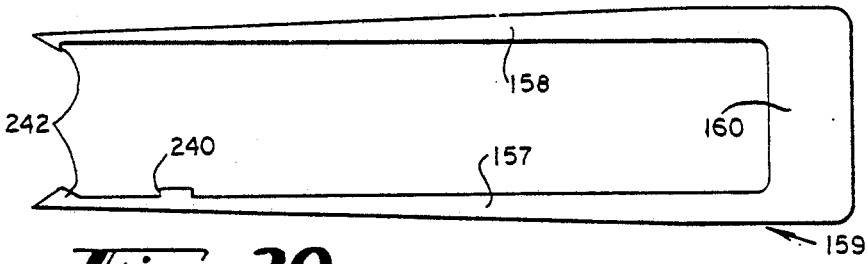
FIG. 20 is a plan view of the extractor.

The arms 157 and 158 of the extractor 59, carried by the bolt 150, slide between the opposed inner surfaces of the receiver plates 117L and 117R, FIG. 14, whenever the bolt is between the receiver plates. The extractor arms thus provide additional lateral guidance of the bolt carrier assembly 148 within the receiver plates. The outer surfaces of the extractor arms 157 and 158 have slight inward taper extending forwardly from the connecting bridge 60, as best seen in FIG. 20, and this taper helps guide the bolt between the back ends 161L, 161R of the receiver plates as the action spring 45 returns the bolt carrier assembly 148 forwardly from its full-recoil position shown in FIG. 4. The forwardly-tapering extractor arms also help guide the bolt into the barrel extension 120, as becomes more apparent below.

The tops of the two sheet metal receiver plates 117L and 117R are bent inwardly toward each other as shown at 183, FIGS. 13 and 14, defining an elongated slot 184 (FIGS. 14 and 17) between the tops of the receiver plates. This elongated slot 184 extends forwardly from the rear sight 138 to the forward end 185 (FIG. 2) of the receiver plates, and the charging slide assembly 187 is held between the receiver plates for sliding reciprocal movement in the slot.

The charging slide assembly 188 includes the elongated slide 189 and the charging handle 190 pivotably attached at the front of the slide. The slide 189 is fabricated from elongated upper plate 191 and lower plate 192 (FIG. 22) of substantially equal width along the majority of their length, with a substantially narrower intermediate plate 193 interconnecting the upper and lower plates to define the elongated channels 194 along both sides of the slide 189. The entire slide, including the upper and lower plates and the intermediate plate 193, can be a weldment of sheetmetal members. The channels 194 of the slide 189 fit within the confronting receiver plates edges defining the slot 184, with sufficient play to allow the slide to reciprocate within that slot.

Figure 18:
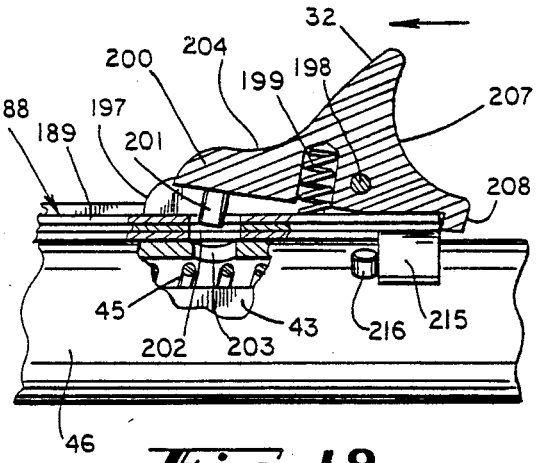
FIG. 18 is a fragmentary and partially sectioned view showing the gas piston rod and charging handle assembly.
Figure 19:
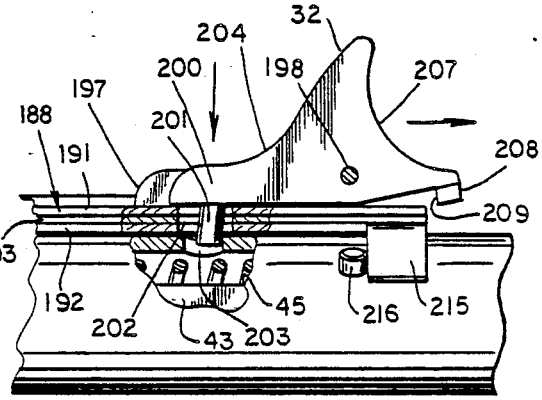
FIG. 19 is a view similar to FIG. 18, showing the charging handle assisting forward movement of the gas piston rod.

The forward end of the charging slide upper plate 191 is bent to form the upwardly-facing U-shaped channel 197, and the charging handle 32 is pivotably mounted within that channel by the pin 198. A compression spring 199 (FIG. 18) fits within a vertical cavity in the underside of the charging handle 32 behind the pivot pin 198, and presses downwardly against the upper plate 191 so as to bias the charging handle forwardly. A finger 200 is formed at the back of the charging handle 32, and a lug 201 projects downwardly from the underside of that finger. The lug 201 is aligned with the hole 202 through the slide 189, and with the hole 203 at the top of the gas piston rod 46 in forward position, as best seen in FIGS. 3 and 18. The spring 199 normally maintains the lug 201 out of the holes 202 and 203, although downward finger pressure directed against the finger area 204 at the back of the charging handle moves the lug 201 downwardly through the opening 202 in the slide to engage the piston rod through the opening 203 (FIG. 19).

Figure 18A:
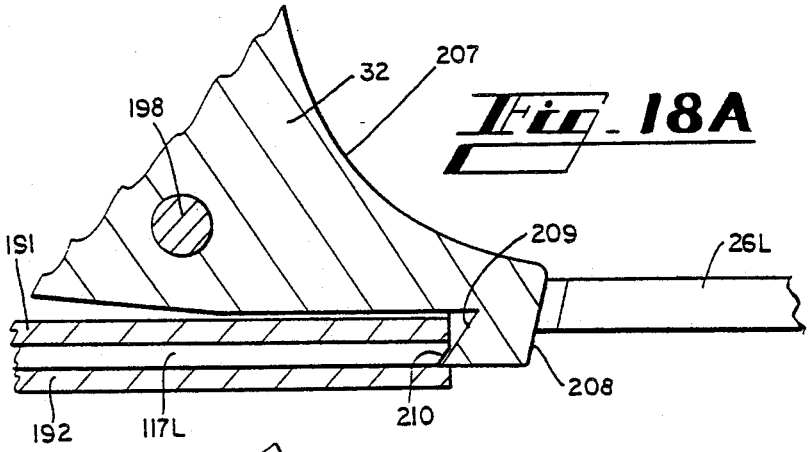
FIGS. 18A and 18B are enlarged fragmentary views taken along line 18A—18A of FIG. 22.
Figure 18B:
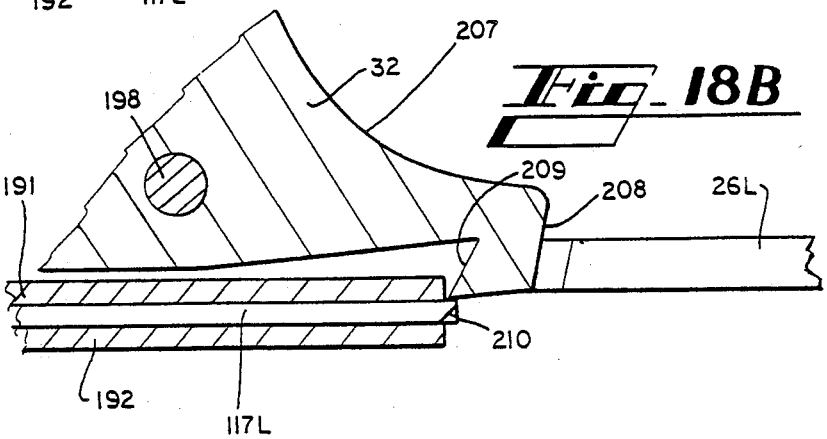

A charging finger area 207 is formed on the front of the charging handle 32, above the handle head 208 which extends downwardly below the forward end of the slide upper plate 191. An angled locking surface 209 is formed at the back of the handle lug 208, and this locking surface engages the angled front edge 210 of each receiver plate immediately in front of the slot 184. The entire charging slide assembly 189 thus can be locked in the full-forward position by pivoting the handle forwardly to engage the receiver plate front edges 210 by the locking surface 209, FIG. 18A, and this locking engagement is assisted by the acute angle of the locking surface and by the force of the spring 199 acting on the charging handle. FIG. 18B shows the charging handle 32 unlocked.

Figure 17:
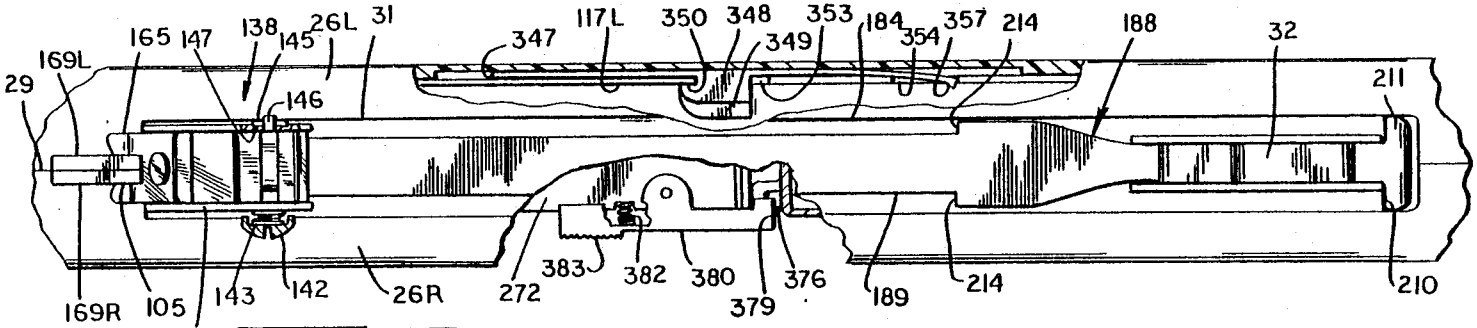
FIG. 17 is a fragmentary top view of the assembled firearm, with portions broken away for illustration.

The head of the charging handle 32 is enlarged to a hammer-head shape 211 as best seen in FIGS. 13 and 17. This enlarged hammer head portion contacts the forward end 212 of the slot 213 formed by the stock shells to accommodate reciprocal movement of the charging slide assembly, and the enlarged hammer head configuration cushions the impact of the charging handle against the stock slot forward end 212 when the bolt assembly is allowed to carry the slide assembly forward.

Rearward movement of the charging slide assembly 188 is limited by the laterally-extending ears 214 formed on the upper plate 191 a short distance behind the charging handle channel 197. These ears 214 extend laterally outwardly above the slot 184 in which the charging slide 189 travels, and the ears engage the rear sight posts 138L, 138R to limit rearward movement of the slide.

Figure 22:
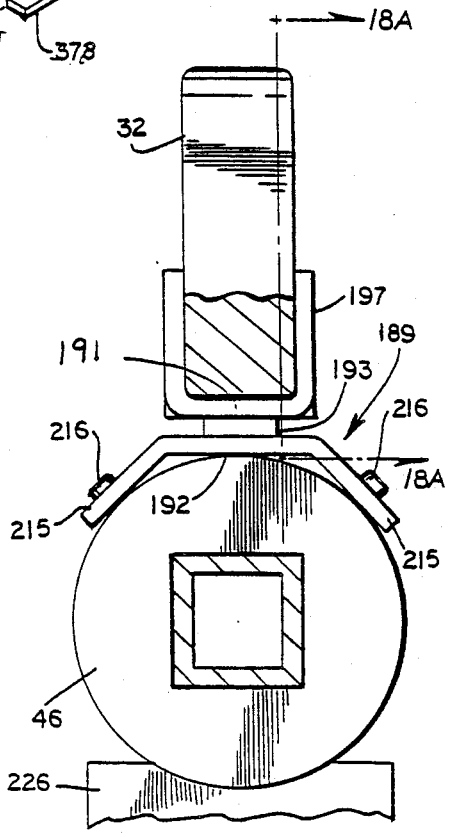
FIG. 22 is a partially-broken elevation view along line 22—22 of FIG. 4, showing details of the charging slide.

The front end of the lower plate 192, making up the charging slide 189, is laterally enlarged and bent downwardly to form the two fingers 215, FIG. 22. These fingers 215 extend downwardly at approximately 45 degrees from horizontal, and are closely spaced apart from the gas piston rod 46. A pair of studs 216 extend outwardly from the gas piston rod 46 closely behind the fingers 215, with each stud nominally centered on a 45-degree radial relatively to vertical. When the charging slide assembly 188 is moved rearwardly in the slot 184, after disengaging the locking surface 209 from the front edges 210 of the receiver plates, the fingers 215 engage corresponding studs 216 and move the gas piston rod 46 rearwardly with the charging slide assembly. This rearward movement of the charging slide assembly loads and cocks the gun, as becomes apparent below.

Figures 15, 16:
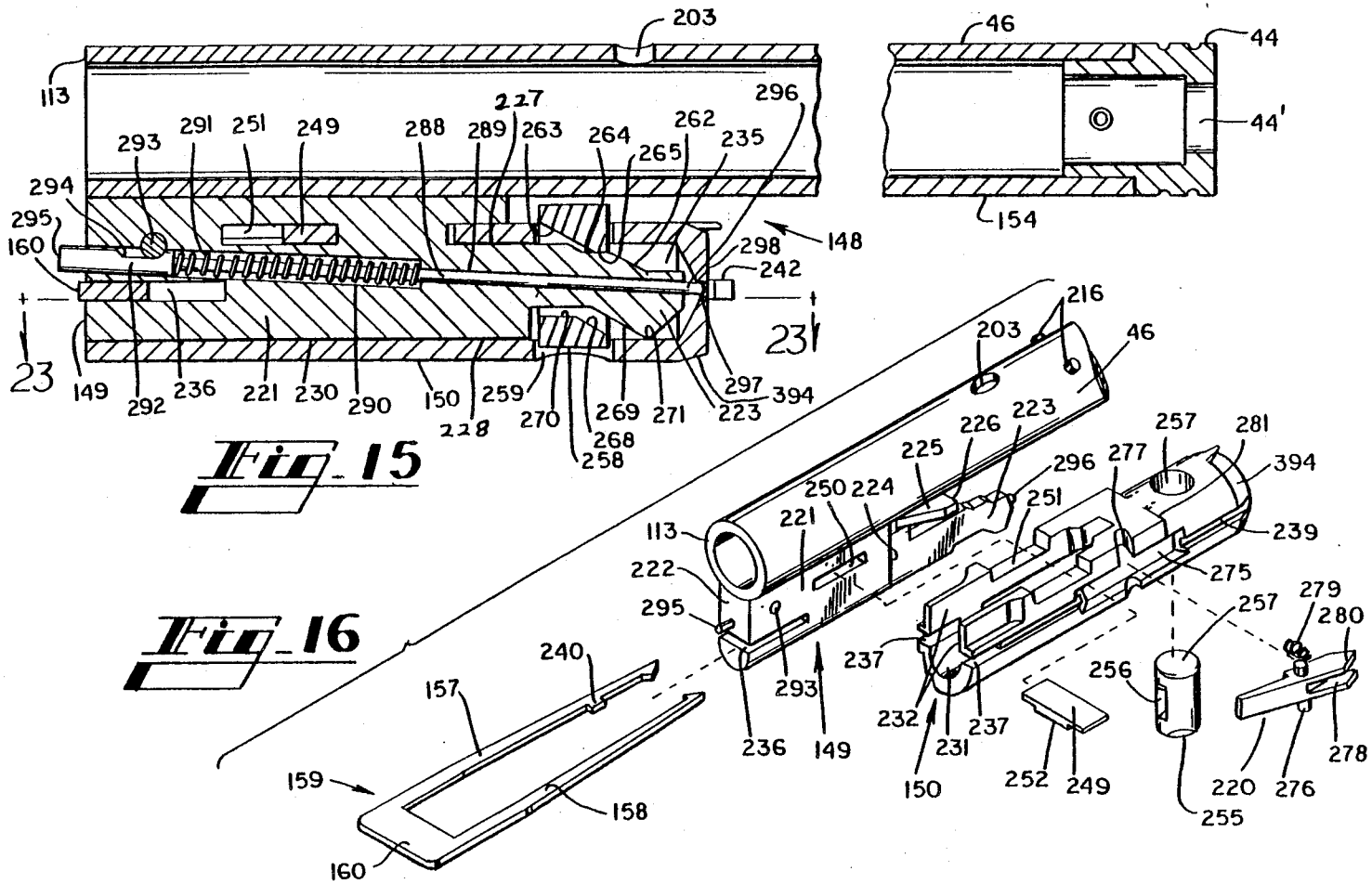
FIG. 15 is a section view showing the bolt carrier assembly with the bolt lock extended in locked position.
FIG. 16 is an exploded view showing details of the bolt carrier assembly.

Details of the bolt carrier assembly 148, including the bolt carrier 149 and bolt 150, are best seen in FIGS. 13, 15, and 16. The bolt carrier 149 preferably is a solid member welded to the rear end of the gas piston rod 46. The bolt 150 fits onto the bolt carrier 149 and may selectably undergo a limited extent of longitudinal movement relative to the bolt carrier; the bolt includes a bolt carrier catch 220 which selectably locks the bolt to the bolt carrier.

Figure 23:
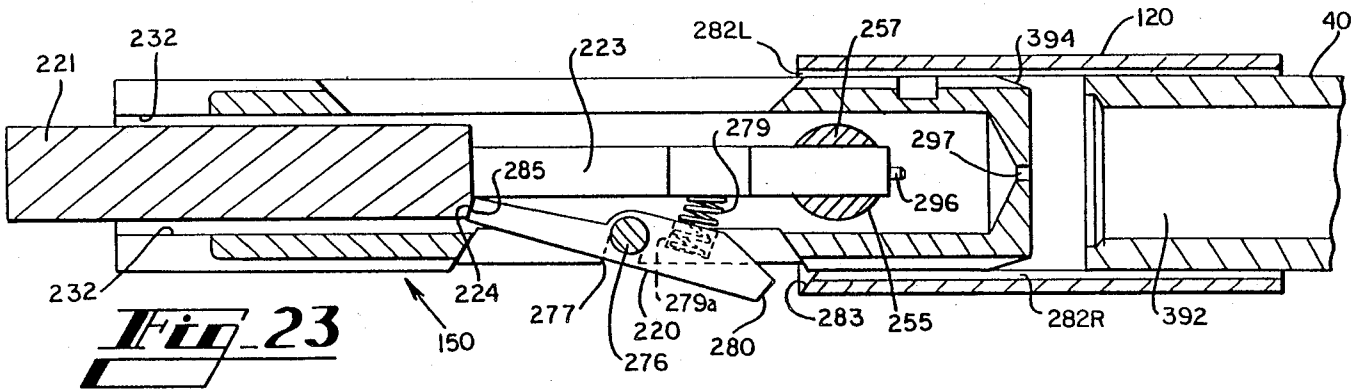
FIG. 23 is a section view along line 23—23 of FIG. 4, showing details of the bolt carrier catch and related parts.

The bolt carrier 149 has a main body portion 221 extending forwardly from the back end 222, substantially aligned with the rear end 113 of the gas piston rod 46, and has a bolt locking finger 223 extending forwardly from the front end 224 of the main body. The bolt carrier main body 221 and the finger 223 are integral, and as best seen in FIG. 23, the finger is narrower than the body so that the front shoulder 224 on the right side of the bolt carrier provides a stop surface for the back end 285 of the bolt carrier catch 220 as described below. An impact plate 225, an integral part of the bolt carrier 149, extends forwardly from the front end 224 of the main body 221, beneath the gas piston rod 46 and spaced above the finger 223. The front surface 226 of the impact plate 225 provides a bolt carrier stop surface which impacts the barrel extension 120 and arests forward movement of the bolt carrier 149.

The main body 221 of the bolt carrier has an arcuate bottom 230 providing a bearing surface complementary to the bottom surface of the longitudinal hole 231 formed in the bolt 150. The top surface of the hole is removed from the rear of the bolt to define a slot between the open-topped sidewalls 232. The slot between the sidewalls 232 receives the main body 221 of the bolt carrier 149. The relative lateral dimensions of the bolt carrier body 221 and the slot in the bolt permit sliding movement of the bolt relative to the bolt carrier.

The bolt 150 is held in assembly on the bolt carrier 149 by sliding contact between the top and bottom of the hollow interior 235 at the forward portion of the bolt, which is an extension of the longitudinal hole 231 in the bolt, and the radius at the top 227 and bottom 228 of the locking finger 223 behind the bolt lock 255; and by the extractor 159 which engages both bolt and bolt carrier in assembly. The bridge end 160 of the extractor fits within the slot 236 extending forwardly from the back end 222 of the bolt carrier body 221, and also extends into the slots 237 in the sidewalls 232 of the bolt 150. The extractor bridge 160 thus interconnects the back ends of the bolt and bolt carrier, and holds those parts in assembly.

The arms 157 and 158 of the extractor fit in the slots 238 (FIG. 24) and 239 (FIG. 16) formed along the left and right sides of the bolt 150. A lug 240 on the inside of the extractor left arm 157 engages a notch 241 (FIG. 24) on the corresponding side of the bolt 150, retaining the extractor 159 in assembly. The forward ends 242 of the extractor arms 157 and 158 are provided with an inwardly-facing hook on the right arm, and an inclined plane on the left arm, sized to engage and extract the rim 243 of a shell 244.

Longitudinal travel of the bolt 150 relative to the bolt carrier 149 is partially limited by the crossbar 249 (FIGS. 15 and 16) which extends transversely through the rectangular window 250 in the bolt carrier body 221. A rectangular slot 251 extends across the top of the bolt 150, and the crossbar 249 fits lengthwise in the bolt slot. The crossbar has an enlarged lower portion 252 which extends downwardly into the channel 231 beneath the slot 251, locating and retaining the crossbar along the lateral dimension of the bolt 150. The width of the crossbar 249 and the window 250 are substantially the same, so that the crossbar is a snug sliding fit in the window. The width of slot 251 across the bolt 150 is substantially greater than the width of the crossbar, as best seen in FIG. 15, allowing the bolt to slide back and forth relative to the bolt carrier. The rearward limit of this relative sliding movement is defined as the crossbar 249 impacts the back surface of the slot 251 in the bolt. Forward movement of the bolt is determined as described below.

Figure 25:
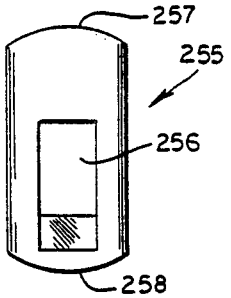
FIG. 25 is a front elevation view of the bolt lock.

A bolt lock 255, FIGS. 15, 16, and 25, is mounted in assembly with the bolt carrier 149 and bolt 150, and functions to selectably lock the bolt to the barrel extension 120 for firing the gun. The lock 255 is cylindrical on the vertical axis, and a rectangular window 256 extends through the lock to accommodate the finger 223 of the bolt carrier 149. The finger 223 slidably fits within the lock window 256, and the cylindrical lock itself slides in the vertical hole 259 through the bolt 150. The upper end 257 and lower end 258 are rounded as shown in FIG. 25, conforming to the top and bottom radii of the bolt 150 at the intersection of the hole 259.

The top and bottom of the bolt carrier finger 223 include camming surfaces and locking surfaces which engage mating surfaces at the top and bottom ends of the window 256 through the lock 255. The first ramp surface 262 on the top of the finger 223 constitutes a locking cam which engages the locking cam surface 263 at the upper end of the lock window. The locking cam surface 263 slopes downwardly from the rear of the window, to join the horizontal holding surface 264 at the front of the window upper end. This holding surface 264 engages the horizontal lock supporting surface 265 at the top of the finger 223, behind the first ramp surface 262.

The lower end of the lock window 256 forms an unlocking cam surface 268, extending rearwardly from the front of the window and confronting the unlocking ramp surface 269 on the underside of the finger 223. A horizontal unlock holding surface 270 joins the upper end of the unlocking cam surface 268, extending rearwardly to the back of the lock window. The locking finger 223 has a horizontal holding surface 271 adjoining the lower end of the unlocking ramp surface 269.

The bolt lock 255 is either raised to the locked position (FIGS. 3 and 15) where the upper end 257 of the lock moves above the bolt hole 259 to engage the hole 274 in the top surface 155 of the barrel extension 120, thereby locking the bolt in the breech of the gun; or moves downwardly into the bolt hole 259 to withdraw from the barrel extension hole 274 and unlock the bolt from the breech, by travel of the bolt carrier 149 relative to the bolt 150. The bolt carrier catch 220, best shown in FIGS. 16 and 23, controls the timing of this relative travel during back-and-forth movement of the bolt carrier assembly The bolt carrier catch 220 is a lever which nests in the elongated window 275 formed in the right side of the bolt 150. A pivot pin 276 extends vertically through the bolt carrier catch 220, and the ends of the pivot pin loosely fit in the rearwardly-angled vertical slot 277 intersecting the window 275 (FIG. 16) in the bolt. The catch 220 is retained within the window 275 by the right arm 158 of the extractor 159, which fits over the catch and passes through the forked opening 278 at the forward end of the catch. A compression spring 279 fits within the recess **279*a* (FIG. 23) of the catch 220 and rides against the bolt carrier finger 223, biasing the forward end 280 of the catch outwardly from the bolt slot 275**.

The forward end 280 of the bolt carrier catch 220 forms an oblique angle complementary to the beveled cam surface 283 (FIGS. 13 and 23) at the right side of the bolt opening 284, at the back end of slot 282R extending within the right side of the barrel extension 120. The back end 285 of the bolt carrier catch 220 normally abuts the front shoulder 224 of the bolt carrier main body 221, thereby latching the bolt and preventing the bolt from traveling rearwardly relative to the bolt carrier. It will be recalled that the crossbar 249 and slot 251 limits the maximum forward travel of the bolt relative to the bolt carrier.

When the bolt carrier assembly 148 travels forwardly along the guide rod 43 so that the forward end 280 of the bolt carrier catch engages the cam surface 283 on the barrel extension, the bolt carrier catch pivots about the pin 276 to disengage the back end 285 from the shoulder 224 at the front end of the bolt carrier main body. The bolt 150 thus is unlatched from the bolt carrier 149, permitting further forward travel of the bolt carrier to cam the bolt lock 255 upwardly through the bolt and into the locking hole 274 in the barrel extension. The slight inward taper of the extractor arms 157 and 158 helps guide the bolt 150 into the barrel extension opening 284 at this time, with the extractor right arm 158 entering the barrel extension slot 282R ahead of the front end 220 of the bolt carrier catch engages the cam surface 283. The extractor left arm 157 likewise enters the slot 282L, FIG. 23, extending within the left side of the barrel extension.

The rearwardly-angled slot 277 for receiving the pivot pin 276 allows the bolt carrier catch to be assembled or removed from the bolt without requiring a separate removable pin. The bolt carrier catch, with its back end 285 engaging the shoulder 224 of the bolt carrier, holds the bolt forward on the bolt carrier while the bolt carrier assembly is unlocked and out of the barrel extension.

The firing pin 288, FIG. 15, extends longitudinally through the firing pin passage 289 in the bolt carrier 149. The firing pin passage is counterbored at 290, from the back end of the bolt carrier, and the firing pin compression spring 291 fits between the bottom of the counterbore and the enlarged head 292 of the firing pin. A retaining pin 293 extends transversely through the bolt carrier, engaging an elongated notch 294 in the firing pin head 292. The back end 295 of the firing pin protrudes outwardly from the back end 222 of the bolt carrier.

The firing pin 288 extends through the length of the bolt locking finger 223, and the forward end 296 of the firing pin protrudes outwardly a short distance from the front end of the finger. The firing pin forward end 296 is aligned with the firing pin opening 297 in the front face 298 of the bolt 150, and with the bolt carrier assembly 148 in the forward-locked position shown in FIG. 15, the firing pin spring 291 keeps the firing pin forward end retracted within the firing pin opening in the bolt face. When the hammer strikes the back end 295 of the firing pin as discussed below, the firing pin moves forwardly a distance determined by the firing pin notch 294, moving the firing pin forward end 296 through the bolt hole 297 to strike the primer of a cartridge. The straight firing pin 288 is angled within the bolt carrier, with the rear end of the firing pin being elevated sufficiently to clear the extractor slot 236 in the back of the bolt carrier.

The hammer 302 and the trigger mechanism 303 of the gun 25 are pictorially shown in FIG. 13, and in various operational stages in FIGS. 3, 4, 26A, and 26B. The hammer 302 pivots on a pin 304, an end of which fits in the hole 305 at the front of each gusset plate 306 secured to the exterior of the receiver plates 117L, 117R. The hammer is urged forwardly by the hammer spring 307, whose legs 307, **307*a* extend behind the hammer and engage the top sides of retaining grooves 308 formed around the rotatable safety 309. The safety 309 extends through holes 310 formed in the receiver plates, and has a safety operating lever 311 (FIG. 1B) on the left side of the gun, above the pistol grip 34. The hammer 302 has a firing pin engaging surface 312 (FIG. 26A) which engages the back end 295** of the firing pin 288 when the hammer swings to the full-forward position, FIG. 3, under power of the hammer spring. Near its outer end 313, the hammer is cut away to form a radius 313 for engaging the front end of the bolt 150, when the bolt is returning from overtravel as described below. A hook 314 on the underside of the hammer 302 engages the disconnector 315 of the trigger mechanism 303. A lateral notch 316 extends the width of the broadened circumferential surface 317 at the base of the hammer, and this notch provides a sear surface for engaging either the trigger or the hammer timing lever of the trigger mechanism.

Figure 27:
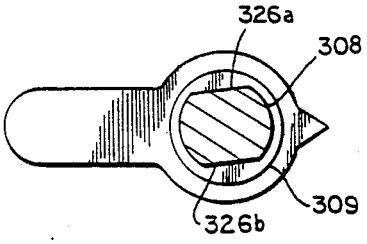
FIG. 27 is a section view of the safety member in the firing mechanism of said firearm.

The trigger mechanism 303 includes the trigger 320 having an elongated longitudinal channel 321 defining an upwardly-facing slot for receiving the disconnector 315, and the hammer timing lever 322. The trigger, disconnector, and timing lever are pivotably mounted on the trigger pin 323 which extends through the back hole 324 in each gusset plate 306 attached to the receiver plates. A trigger spring 325 fits beneath the forward end of the trigger channel 321 and biases the trigger mechanism in the counterclockwise direction, as viewed in FIG. 13. The legs 325*a* of the trigger spring extend behind the trigger mechanism and engage the underside of the grooves 308 in the safety 309. Flat surfaces 326*a* and 326*b* (FIG. 27) are formed in the safety grooves 308 to detent the safety in either the "safe" or "fire" positions, FIG. 28. The grooves 308 in the safety thus function to retain the legs of both the hammer spring 307 and the trigger mechanism spring 325, and to detent the safety.

Figure 26A:
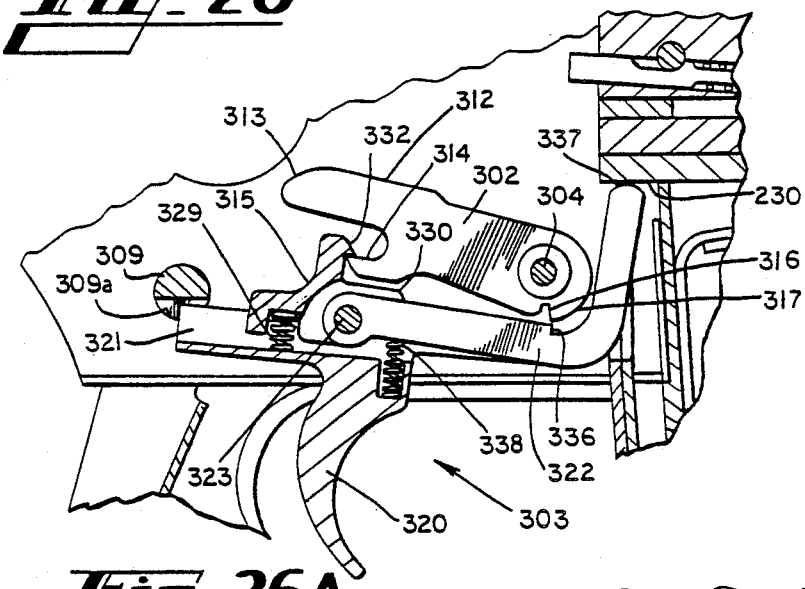
FIGS. 26A, 26B, and 26C are detailed elevation views showing the firing mechanism of said firearm, respectively in disconnector-engaged, sear, and hammer timing lever positions.
Figure 26B:
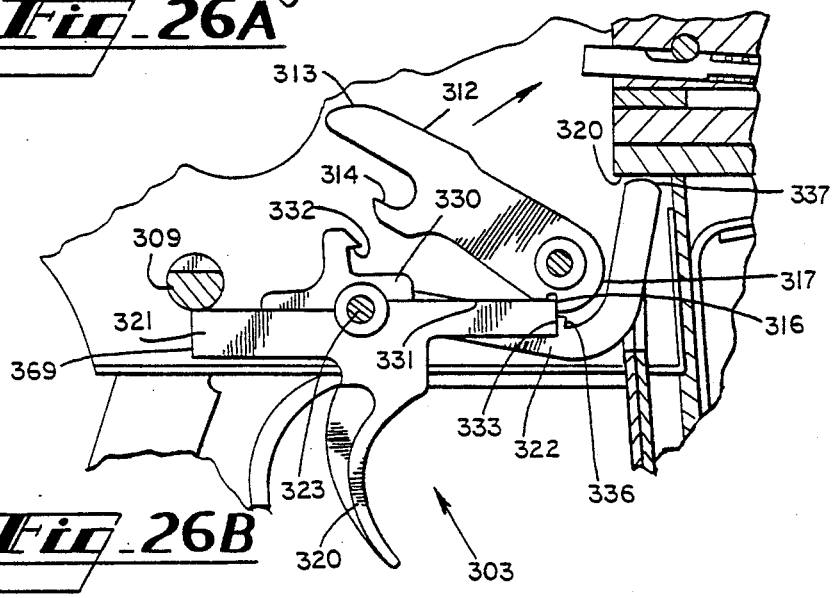

The disconnector 315 is powered forwardly in the trigger channel 321 by the disconnector spring 329 (FIG. 26A) located behind the trigger pivot pin 323. The forward end 330 of the disconnector is forked, providing a slot to receive the hammer timing lever 322, and the disconnector forward end abuts the narrowed forward portion 331 of the trigger channel 321 to limit maximum forward rotation of the disconnector. The disconnector 315 has a hook 332 approximately above the trigger pin 323, in position to engage the hook 314 of the hammer 302 when the hammer is pushed back by rearward travel of the bolt carrier assembly. It will be understood that the disconnector hook 332 is rotated forwardly into position for engaging the hammer hook 314 only when the trigger 320 is held back by finger pressure, as illustrated in FIG. 26A. The disconnector hook 332 is rotated rearwardly out of possible engagement with the hammer hook 314 when the trigger is released, shown in FIGS. 4 and 26B. Thus, when the trigger 320 is released after rearward travel of the bolt carrier assembly has moved the hammer 302 back to engage the disconnector 315 as shown in FIG. 26A, the hammer 302 is allowed to rotate forward to sear position as illustrated in FIG. 26B, where the forward edges 333 of the trigger channel 321 engage the sear notch 316 of the hammer. The hammer 302 thus is held in sear position by the trigger 320, ready for forward movement (FIG. 3) toward the firing pin when the trigger is pulled.

Because the bolt carrier assembly 148 of the gun can overtravel the hammer and trigger mechanism during recoil, as illustrated in FIG. 4, a shooter who quickly releases and repulls the trigger while the bolt carrier assembly is behind the hammer can cause premature rotation of the hammer to the firing position, ahead of the bolt. The radius 313 at the outer end of the hammer 302 engages the underside of the gas piston rod 46 if premature hammer release occurs, jamming the gas piston rod to prevent further forward movement, so that the bolt cannot slam into the hammer and damage parts of the gun.

Further precaution against premature hammer release is provided by the hammer timing lever 322, which pivots about the trigger pin 323 and extends forwardly within the forked forward end 330 of the disconnector and within the channel 321 of the trigger. A hammer engaging notch 336 is formed on the upper side of the hammer timing lever 322, approximately beneath the hammer pivot pin 304. The hammer timing lever curves upwardly in front of the base 317 of the hammer, loosely fitting slidably in the slot 128 (FIG. 13) at the top of the magazine bracket 123, and terminates at the bolt contacting surface 337. A compression spring 338 (FIG. 26A) fits within a recess 339 formed in the trigger channel 321 forwardly of the trigger pin 323, and urges upwardly the hammer timing lever 322 relative to the trigger 320.

Figure 26C:
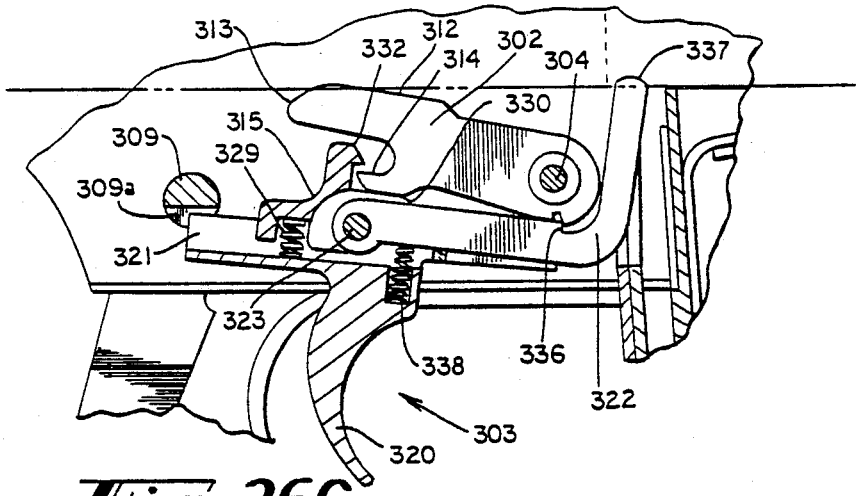

The bolt contacting surface 337 of the hammer timing lever normally rides against the bottom surface 230 of the bolt 150, keeping the hammer timing lever depressed against the force of the spring 338 and maintaining the hammer engaging notch 336 out of possible engagement with the sear notch 316 of the hammer. Whenever the bolt carrier assembly overtravels the hammer as shown in FIG. 4 and 26C, the spring 338 moves the hammer timing lever upwardly so that the hammer engaging notch 336 contacts the hammer. The hammer engaging notch of the disconnector is positioned to engage the sear notch 316 of the hammer slightly ahead of sear notch engagement by the sear edges 333 of the trigger 320, if the trigger remains pulled at this time. The timing lever always holds the hammer in the position shown in FIG. 26C while the bolt carrier assembly has overtraveled the hammer, even if the trigger is released and then repulled while the bolt carrier assembly is behind the hammer. Forward rotation of the hammer thus is arested behind the disconnector position (FIG. 26A) while the bolt carrier assembly remains in overtravel position behind the hammer. The timing lever 322 also holds down the hammer for installing the bolt carrier assembly in the gun.

Subsequent forward movement of the bolt carrier assembly engages the bolt contacting surface 337 to disengage the hammer engaging surface 36 from the sear notch 316 of the hammer. The hammer 302 can now rotate forwardly an additional small amount to the sear position, shown in FIG. 26B. It will thus be understood that the hammer timing lever 322 positively prevents premature release of the hammer while the bolt carrier assembly is behind the hammer and trigger mechanism.

Figure 24:
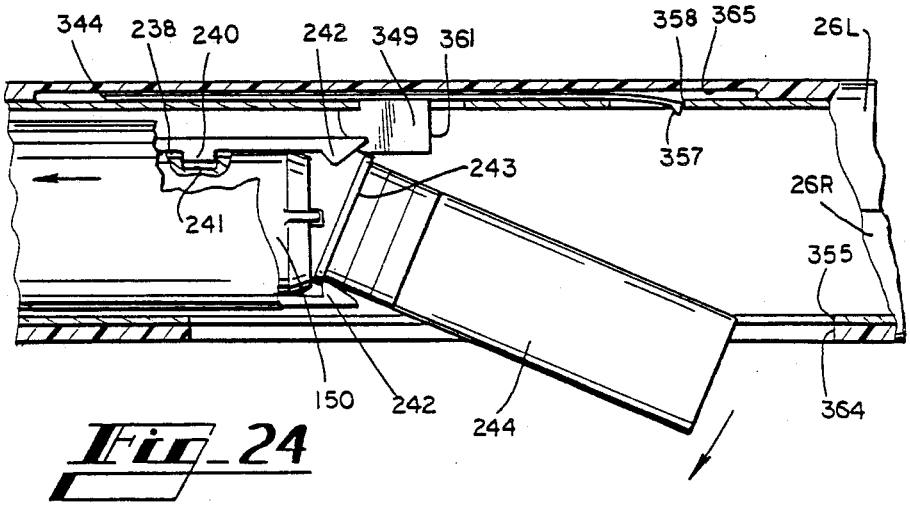
FIG. 24 is a fragmentary sectioned plan view illustrating ejection of a spent shell from said firearm.
Figure 29:
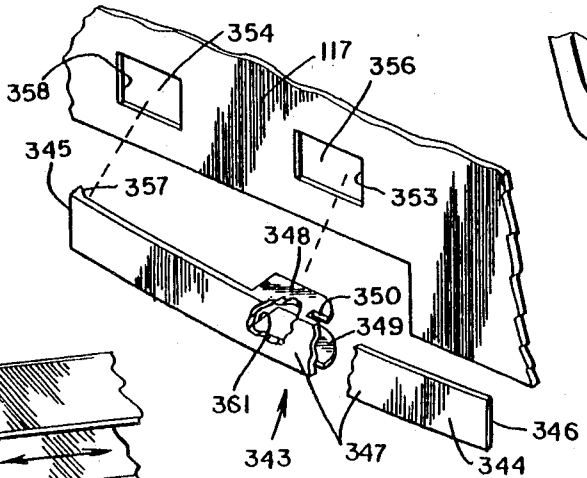
FIG. 29 is an exploded view showing the ejector and a fragmentary portion of the left receiver plate.

The ejector 343 is shown in detail in FIG. 29, and also appears in FIG. 4 and 24. The ejector 343 includes an elongated member 344 having a forward end 345 and a back end 346 bowed slightly inwardly in the free state (FIG. 29) relative to the central portion 347.

Extending inwardly from the ejector member 344 are upper leg 348 and lower leg 349. The lower leg 349 extends inwardly from the central portion 347 a greater distance than the upper leg 348. A rearwardly-facing notch 350 lies between each leg of the ejector, and the extractor member 344. The entire ejector 343 can be fabricated by stamping and bending from sheet metal or the like.

Referring to FIGS. 4 and 29, the left receiver plate 117L has a rear window 353 and a front window 354 substantially aligned with the recoil travel path of the bolt 150, and transversely aligned with the cartridge ejection port 355 (FIGS. 2 and 13) formed in the right receiver plate 117R. The longitudinal spacing between windows 353 and 354 allows the upper and lower legs 348 and 349 of the ejector to be pressed inwardly through the rear window 353, with the forward end 345 of the ejector body to be slightly ahead of the front window 354. To mount the ejector in the gun, the ejector body 344 is pushed in toward the left receiver plate with the legs 348, 349 extending into the rear window 353. This inward force elastically straightens the normally-bowed ejector body 344. By sliding the ejector body to the rear, the notches 350 of the upper and lower legs 348, 349 engage the back wall 356 of the rear window 353 (FIG. 24), and at this time the forward end 345 of the ejector body snaps into the front window 354, effectively locking the ejector in place on the left receiver plate 117L. The ejector forward end 355 is provided with an inwardly-projecting foot 357 which engages the front wall 358 of the front window 354 in the left receiver plate, thereby further securing the ejector in place against unwanted movement.

The front surface 361 of the ejector lower leg 348 constitutes the ejection surface, as best illustrated in FIG. 24. As the bolt 150 travels rearwardly in recoil, the extractor hooks 242 engage the rim 243 of the spent shell 244, extracting that shell from the chamber end 362 (FIG. 3) of the barrel. A longitudinal notch 363 (FIG. 14) is formed in the left side of the bolt 150, below the extractor left arm 157, providing clearance for the ejector lower leg 349; the ejector upper leg 348, being shorter, does not interfere with bolt travel.

Rearward movement of the bolt 150 and the extracted shell 244 continues until the shell rim 243 strikes the ejection surface 361 of the ejector lower leg 349, ejecting the shell to the right through the ejection port 355 in the right receiver plate and the aligned ejection opening 364 (FIG. 1A) in the right stock shell 26R.

The ejector 343 thus is fabricated from a single piece of metal, and is easily installed or removed from the gun from the outside of the left receiver plate. A shallow depression 365 (FIG. 24) may be formed on the inside of the left stock shell 26L to accommodate the added thickness of the ejector body 344.

The operation of safety 309 is best understood with respect to FIGS. 3, 4, 13, 26A, and 26B. The safety 309 is rotatably held between the receiver plates 117L and 117R above the back end 369 of the trigger channel 321, and the legs of the trigger and hammer springs in the grooves 308 retain the safety between the receiver plates and detent the safety. A notch 309*a* is formed in the safety 309 between the spring-receiving grooves 308, and this notch is sufficiently deep to accommodate upward movement of the trigger channel back end 369 when the trigger is pulled, as illustrated in FIG. 26A. However, when the safety is rotated approximately a half-turn, the groove 309*a* is rotated out of alignment with the back end 309 of the trigger, as seen in FIG. 4. The ungrooved portion of the safety 309, in this position, effectively blocks the back end 369 of the safety, preventing trigger movement.

Figure 28:
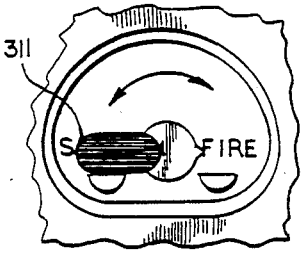
FIG. 28 is a fragmentary elevation view showing the operating lever for the safety.

The safety 309 is operated by the integral safety lever 311, FIGS. 1B and 28, on the left side of the gun. The safety 309 extends outwardly through the left receiver plate and through a mating opening in the left stock shell 26L, there terminating in the safety lever 311. The safety lever 311 is readily engaged by the shooter to place the gun in either "safe" or "fire" condition.

Figure 30:
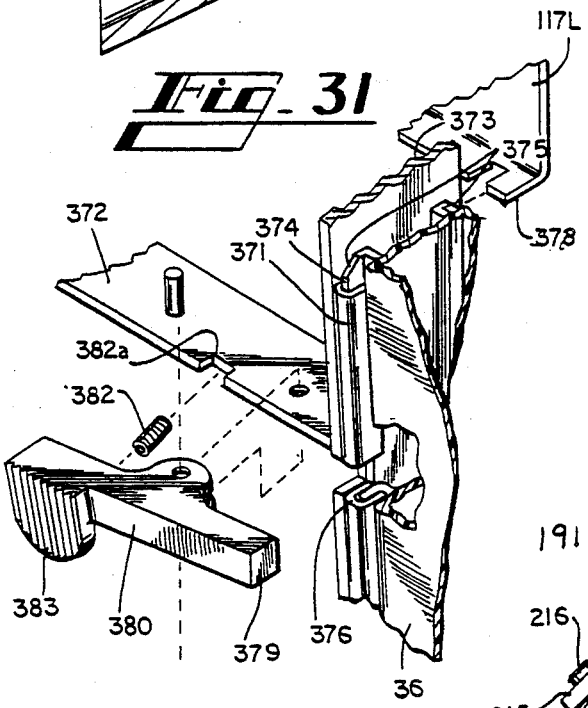
FIG. 30 is a fragmentary view of the trigger guard and magazine bracket, shown exploded and partially broken away.

The magazine bracket 123 is shown in greater detail in FIG. 30. The magazine bracket includes a forwardly-facing channel member 371 extending vertically downwardly from the receiver section at the forward end of the trigger 320 and trigger guard 372, terminating at the bottom of the cutaway portion 130 (FIG. 2) between the magazine bracket 123 and the grip bracket 35. The channel member 371 may be a separate C-shaped member attached to the upright plate forming the front leg 373 of the unitary member also forming the grip bracket 35 and the rear bracket leg 129. The trigger guard 372 is a separate part extending between the rear bracket leg 129 and front bracket leg 373, and is secured to those two legs by staking or the like.

The magazine channel member 371 slidably receives the magazine lug 374 on the back of the magazine 36. The upper ends of the magazine lug 374 are preferably beveled as at 375 (FIG. 30), and a latching notch 376 is formed in the right edge of the magazine lug. The left upper end of the magazine lug 374 strikes the underside of the tab 378, bent inwardly from the bottom of the left receiver plate 117L, to stop upward movement in the channel 371. When the magazine 36 is attached to the gun by sliding the lug 374 fully into the magazine lug channel 371, the latching notch 376 engages the forward end 379 of the magazine latch 380 pivotably attached to the trigger guard 372. The forward end 379 of the magazine latch fits within a slot 381 (FIG. 13) formed in the right side of the magazine bracket 123, and this slot is aligned with the latching notch 376 in the magazine lug 374 when the magazine is fully attached to the gun. A compression spring 382 (FIGS. 17 and 30) fits between the magazine latch 380 and the notch 382*a* in the trigger guard 372 behind the pivot of the magazine latch, and urges the forward end 379 of the magazine latch into engagement with the slot 381 and the latching notch 376 of the magazine lug. The beveled upper end 375 of the magazine lug cams aside the forward end 379 of the magazine latch as the magazine lug slides up the channel 371. The magazine is disengaged from the gun simply by pressing inwardly on the unlatching button 383 at the back end of the magazine latch 380. The magazine channel member 371 and magazine latch 380 thus provide a positive yet simple means for retaining a magazine on the gun.

The magazine 36 herein disclosed is a box magazine including a cartridge follower 386 (FIG. 3) urged upwardly by the magazine spring 387, so as to hold the top cartridge 388 (FIG. 4) urged upwardly against the lips 389 of the magazine, ready to be stripped from the cartridge and chambered by forward movement of the bolt carrier assembly 148. It should be understood that a suitable drum magazine can be substituted for the box magazine 36 disclosed herein, in which case the drum magazine would include a lug comparable to magazine lug 374 for engaging the magazine bracket 123.

A complete loading and firing sequence for the gun 25 is now described. Assuming a cartridge-containing magazine 36 is in place as described above, the charging handle 190 is pulled back by finger pressure applied to the charging finger area 207. This backward movement of the charging handle moves the fingers 215 into contact with the studs 216 extending outwardly from the gas piston rod 46, moving the gas piston rod and attached bolt carrier assembly 148 to the rear.

As rearward movement of the bolt carrier assembly commences, the bolt 150 remains locked in full-forward position by the bolt lock 255 (FIG. 15) extending upwardly through the bolt and engaging the hole 274 in the top surface of the barrel extension 120. This locked-breach condition is shown in FIG. 3. Rearward movement of the gas piston rod 46 moves the bolt carrier 149 back relative to the still-locked bolt 150, and this relative rearward movement causes the bolt lock 255 to be cammed downwardly, thereby unlocking the bolt. This downward camming movement of the bolt lock 255 takes place as the unlocking ramp 269 of the bolt carrier finger 223 engages the unlocking cam surface 268 at the lower end of the window 253 in the bolt lock. The bolt lock 255 moves downwardly until its upper end 257 is substantially flush with the top of the hole 259 in the bolt, at which time the holding surface 271 of the bolt carrier finger rests on the unlocking holding surface 270 within the window of the bolt lock. The bolt is now unlocked and can be withdrawn from the breach by further rearward travel of the gas piston rod and bolt carrier.

Continued rearward movement of the charging handle draws the gas piston rod back between the receiver plates until the ears 214 of the charging slide assembly 188 contact the left and rear posts 138, 139 of the rear sight. During rearward travel, the gas piston rod is laterally guided by the ridges 151 formed in the receiver plates 117L, 117R; and is vertically guided from above by the underside of the charging slide lower plate 192, and on the underside initially by the top surface 155 of the barrel extension 120 and by the upward bias of the hammer 302 pressing against the bottom of the bolt 150.

As the bolt 150 becomes partially withdrawn from the barrel extension 120, the forward end 280 of the bolt carrier catch 220 (FIG. 23) is freed, allowing the back end 285 of the bolt carrier catch to move inwardly and engage the shoulder 224 at the front of the bolt carrier main body 221. Continued rearward movement of the bolt carrier 149 engages the bolt 150 through the cross-bar 249, withdrawing the bolt from its fully-seated position within the barrel extension.

When the charging slide assembly 188 reaches its full-back position, the bolt 150 is substantially at the position shown in FIG. 24 with the extractor hooks 242 withdrawn behind the front surface 361 of the ejector 348. The bolt 150 at this position has cleared the top cartridge 388 (FIG. 4) in the magazine, while remaining over the surface 312 of the hammer 302 at this time. It will be understood that rearward travel of the bolt has moved the hammer back to the position shown in FIG. 26A, and except that the hammer timing lever 322 remains disengaged from the hammer due to engagement with the bolt. The top cartridge 388 moves up in the magazine in the position shown in FIG. 4, awaiting forward bolt movement.

Figure 31:
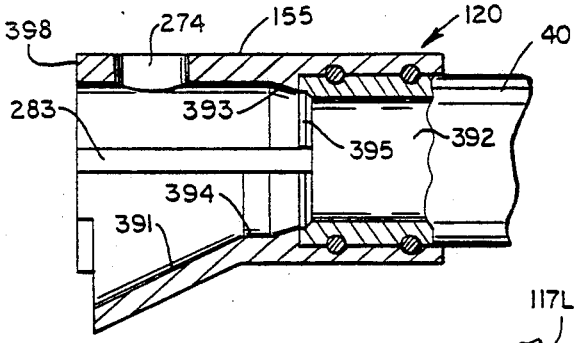
FIG. 31 is a detailed section view of the barrel extension and the barrel rear end.

The charging lever 190 may now be released, allowing the previously-compressed action spring 45 to move forwardly the gas piston rod and bolt carrier assembly. The studs 216 on the gas piston rod carry the charging slide 188 forwardly at this time. The forwardly-moving bolt 150 engages the top cartridge 388 in the magazine, stripping that cartridge from the magazine and moving the cartridge forwardly to contact the inclined ramp 391 (FIG. 31) of the barrel extension 120, chambering the cartridge in the breech end 392 of the barrel 40. The interior of the barrel extension is counterboard to provide the tapered surface 393 adjoining the inner end of the barrel 40. This tapered surface forms a funnel to guide the relatively blunt-nosed shotgun shells into the chamber 392.

Continued forward movement of the bolt carrier assembly returns the forward end of the bolt 150 into the barrel extension 120, where the beveled surface 394 (FIGS. 13 and 16) surrounding the front face 298 of the bolt 150 confronts the tapered surface 393 within the barrel extension. A cylindrical land 394 within the barrel extension, between the inclined ramp 391 and the tapered surface 393, supports the diameter of the bolt 150 in locked position within the barrel extension. The inner end of the barrel 240 is reamed as shown at 395 to accommodate a 12-gauge shotgun shell, in the disclosed embodiment of the gun.

The bolt carrier catch 220, which engaged the shoulder 224 of the bolt carrier as the bolt carrier assembly initially moved rearwardly, keeps the bolt 150 from moving rearwardly relative to the bolt carrier 149 as the bolt carrier assembly travels forwardly in the gun. After the front of the bolt 150 reenters the barrel extension 120, the angled front end 280 of the bolt carrier catch is cammed inwardly by the cam surface 283 at the back of the barrel extension, moving the back end 285 of the bolt carrier catch out of engagement with the bolt carrier shoulder 224. The bolt carrier 149 may now move forward relative to the bolt 150, and this relative movement occurs as the shoulders 281 at the top of the bolt impact the backwall 398 of the barrel extension to arest forward movement of the bolt. Continuing forward movement of the bolt carrier moves the locking finger 223 forwardly within the bolt, causing the locking ramp surface 262 to engage the locking cam surface 263 of the bolt lock 255 so that the bolt lock is cammed upwardly from the bolt to enter the hole 274 in the top wall 155 of the barrel extension 120.

Forward movement of the bolt carrier 149 is arested as the bolt carrier stop surface 226 (FIG. 16) impacts the backwall 398 of the barrel extension. At this time, the bolt carrier has moved forwardly relative to the bolt 150 to place the lock supporting surface 265 beneath the holding surface 264 of the bolt lock 255. The bolt carrier assembly is now locked in full-forward position, and the gun is ready to be fired.

Pulling the trigger 320 releases the hammer 302 from its sear position, FIG. 26B, allowing the hammer to fall against the back end 295 of the firing pin 288. The firing pin thus moves forwardly within the bolt carrier 149 to the extent permitted by the notch 294 and retaining pin 293, forcing the firing pin forward end 296 through the opening 297 in the front face 298 of the bolt 150. The firing pin thus strikes the primer of the previously-chambered shell, firing the gun.

As the gun is fired, gas pressure within the barrel flows through the gas ports 68 to enter the gas cylinder 69, flowing around the guide rod 43 and through the aligned gas holes 70 in the guide rod in the process. The gas pressure forces the gas piston 44 and piston rod 46 rearwardly on the guide rod 43, unlocking the bolt 150 as previously described and moving the bolt carrier assembly rearwardly. The spent shell 244 is extracted by the extractor hooks 244 and carried rearwardly with the bolt until the shell strikes the front surface 361 of the ejector, whereupon the spent shell is ejected as shown in FIG. 24.

The present gun is designed to permit the bolt carrier assembly 148 to recoil rearwardly all the way to the buttplate 27, as illustrated in FIG. 4, whereat the bolt 150 has overtraveled well behind the hammer and firing mechanism of the gun. The noncircular cross-section shape of the guide rod 43, in concert with the mating guide rod travel hole 44*a* in the gas piston, maintains the bolt carrier assembly 148 in angular alignment while the bolt and bolt carrier travel behind the back ends 161 of the receiver plates. The slight inward angular alignment of the extractor arms 157 and 158 helps guide the bolt carrier between the receiver plate back ends 161, as the compressed action spring 45 moves the bolt carrier assembly 148 forwardly. The relatively long recoil travel of the bolt carrier assembly, as discussed above, spreads the recoil force over a longer time and thus reduces the impulse of that force. Moreover, gas pressure within the gas cylinder produces a reaction force on the gas cylinder/front sight 28, and this reaction force is mechanically coupled to the buttplate and the rest of the gun by the guide rod 43, thereby further reducing the recoil force felt by the shooter.

If it should become necessary for any reason to assist the forward movement of the bolt carrier assembly during cocking or otherwise, the charging handle 32 can be moved forwardly by pressing downwardly on the finger area 204 to move the lug 201 into engagement with the hole 203 in the gas piston rod 46. The gas piston rod may now be pushed forwardly with the charging handle 190.

Figure 36:
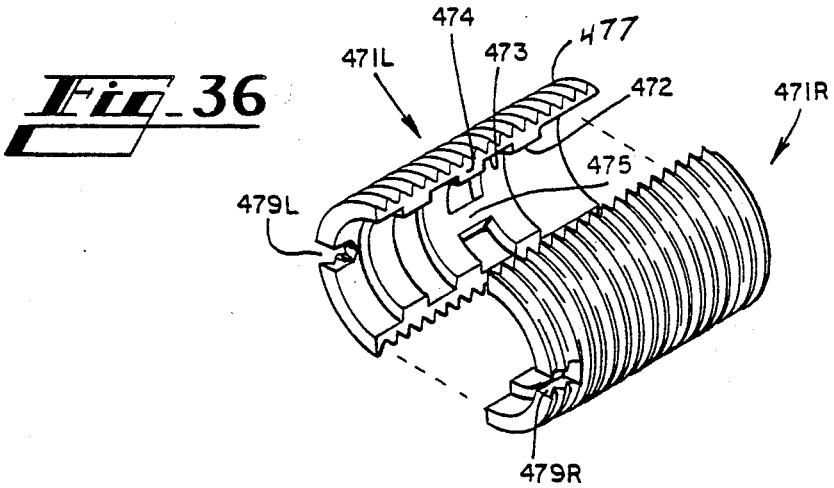
FIG. 36 is an exploded view of a muzzle accessory adapter for the disclosed firearm according to an embodiment of the present invention.
Figure 37:
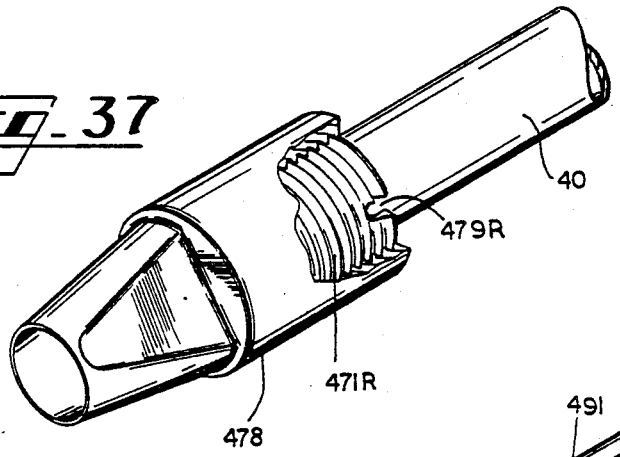
FIG. 37 is a pictorial view showing the adapter of FIG. 36 attached to the firearm.

The several annular grooves 470 adjacent the muzzle 42 of the barrel 40 accommodates the accessory adaptor system illustrated in FIGS. 36 and 37. This accessory adaptor system allows chokes or other threaded accessories to be attached to the front of the barrel, without requiring relatively fine and easily-damaged threads on the barrel. Referring to FIG. 36, the adaptors include a pair of adaptor shells 471L and 471R, each shell being the shape of a half-cylinder. The inner surfaces of each adaptor shell have alternating lands 472 and grooves 473, which complement in width and spacing the grooves 470 on the gun barrel 40. Two adjacent lands are interconnected by the bridge 475, which mates with the groove 476 (FIG. 1B) joining two adjacent barrel grooves. The nominal inside diameter of each adaptor shell is the same as the outside diameter of the gun barrel adjacent the muzzle end, so that the adaptor shells closely confront one another along longitudinal edges 474 when the shells are placed over the gun barrel with corresponding lands 472 of each shell snugly fitting in opposite sides of an annular grooves 470 around the barrel.

The exterior surface of each adaptor shell 471L and 471R is threaded as shown at 477, with the threads of each shell being mutually aligned when the shells are fitted on the barrel grooves 470 with the bridge 475 on shell 471L locating the left shell on the left side of the barrel. Thus, an internally-threaded accessory such as the choke 478, FIG. 37, is readily screwed onto the external threads 477 of the adaptor shells 471L, 471R, in place on the barrel grooves 470. The internally-threaded choke 478 imparts inwardly-directed radial force to each adaptor shell, thereby forcing the lands 472 of the shells into tight engagement with the barrel grooves 470 as the choke is screwed onto the shells. The back edge of each adaptor shell may be provided with a corresponding notch 479L, 479R to accommodate a flat-edged tool such as a screwdriver or the like, to hold the adaptor shells against rotation as the choke or other accessory is screwed or unscrewed relative to the shells. As seen in FIG. 36, the bottom of each notch 479L, 479R may be distinctively shaped so as to identify the "left" and "right" adaptor shell. The barrel grooves 470 have further utility in addition to cooperating with the adaptor shells. If a conventional rifle grenade is launched with the grooved barrel, the external grooves 470 act as a gas labyrinth during firing. The barrel grooves 470 thus tend to impede the unwanted escape of gas between the grenade tube and the barrel, without providing any physical barrier impeding forward travel of the moving grenade.

The full-automatic embodiment of the present invention depicted in FIG. 32, 33, 34, and 34A fires from an open bolt, and is selectably capable of full-automatic or semi-automatic firing at the shooter's choice. Apart from a different firing mechanism and certain modifications to the bolt and firing pin, the disclosed full-automatic gun 25′ is substantially similar to the semi-automatic version 25 previously described. For this reason, identical numerals in the following description denote parts common to both disclosed embodiments, and primed numerals indicate corresponding parts modified for use with the full-automatic embodiment. It should be apparent, however, that details of the full-automatic embodiment are not limited to use only in connection with a gun exactly as previously described herein, or to use only with a shotgun.

Referring to FIG. 32, the full-automatic gun 25′ includes a bolt carrier assembly 148 including a gas piston rod 46 and a bolt carrier 149 secured to the underside of the gas piston rod at its rear end. A bolt 150′ is slidably carried by the bolt carrier 149, and a lug 410 projects downwardly from the bottom surface 411 of the bolt at its back end. As described below in greater detail, this lug 410 engages the rear surface 412 of the sear 413 (FIG. 33) to retain the bolt 150′ (and the entire bolt carrier assembly 148′) in the open-bolt cocked position shown in FIG. 32.

A firing pin 288′ extends through the bolt carrier 149 at an angle to clear the bridge 160 of the extractor. The firing pin 288′ is nonmovably affixed within the bolt carrier 149 by the retaining pin 293′, extending transversely through the bolt carrier and engaging a mating notch 414 formed in the firing pin. The firing pin 288′ thus is fixed in place relative to the bolt carrier 149, with the firing pin forward end 296′ projecting in front of the bolt locking finger 223 as shown in FIG. 32. This forward extension of the firing pin end 296′ causes that end to protrude through the firing pin opening 297′ in the front face 298′ (FIG. 34A) of the bolt 150′ whenever the bolt carrier moves forward, relative to the bolt, to the locked-breech position described above. The fixed firing pin 288′ thus contacts the primer of a chambered cartridge (not shown) immediately after the bolt 150′ is locked and ready for firing.

The firing mechanism of the full-automatic gun embodiment 25′ includes the trigger 418 pivotably supported on the trigger pin 323′, which extends through mounting holes comparable to the holes 324 (FIG. 13) formed in the receiver plates and the gusset plates, although as pointed out below, the gusset plates used with the full-automatic embodiment are modified from the gusset plates 306 shown in FIG. 13. A torsional trigger spring 325′ extends on each side of the trigger surrounding the trigger pin 323′, the trigger spring forming a loop extending beneath the nose 419 of the trigger. The two trigger spring legs 325*a*′ extend back along either side of the trigger, and fit within grooves 420 at either end of the firing selector 421, FIG. 33, which is the counterpart of the safety 309 in the semi-automatic embodiment described above.

A disconnector 424 is pivotably mounted within a slot extending inwardly from the tail 425 of the trigger 418. The disconnector 424 includes a spring bearing surface 423 (FIG. 32) which engages the lower end of the disconnector compression spring 426 fitting within the recess 427 formed in the trigger behind the trigger pivot pin, and the disconnector spring urges the disconnector forwardly relative to the trigger. The disconnector 424 has an arm 428 extending upwardly to terminate at the sear engaging surface 429. The disconnector further has a selector bearing surface 430 on another arm extending behind the pivot pin 431 of the disconnector. The selector bearing surface 430 is positioned beneath the firing selector 421, described below in greater detail.

Figure 33:
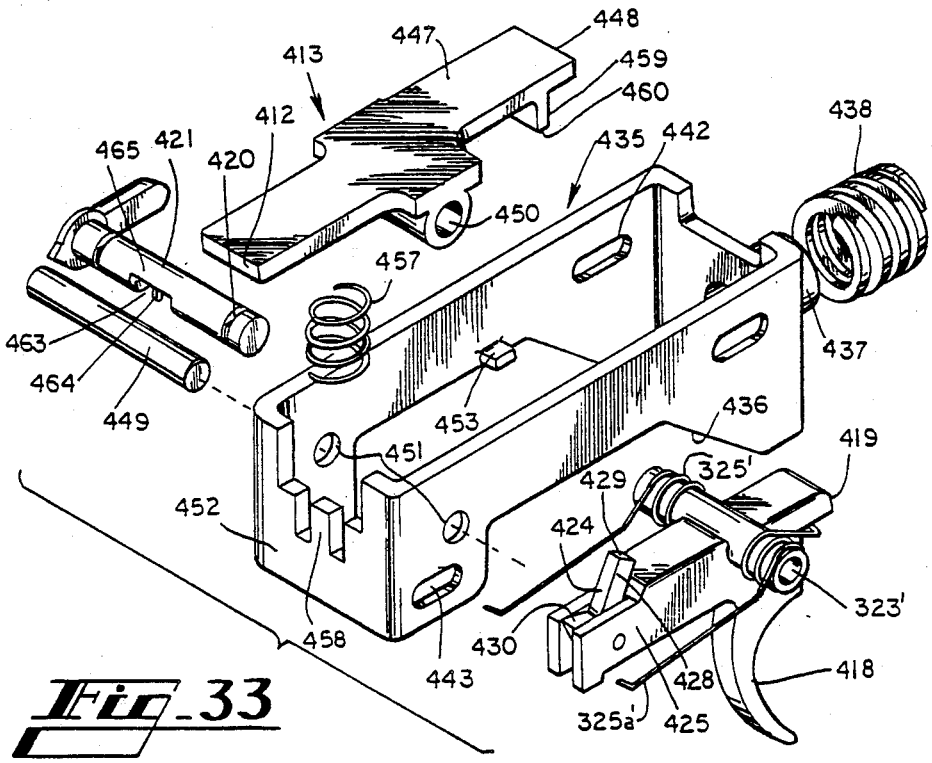
FIG. 33 is an exploded view of the firing mechanism shown in FIG. 32.

Located above the trigger 418 is the sear carrier 435, best seen in FIG. 33. The sear carrier is an annular box-like part open at the top and bottom, with the bottom edges cut away at 436 to allow the sear carrier to fit over the trigger 418 in assembly. A lug 437 extends forwardly from the front end of the sear carrier 435, forming a guide for the heavy buffer compression spring 438 positioned between the sear carrier and the confronting surface 439 of the magazine bracket 123. The sear carrier 435 is supported between the receiver plates by two sear carrier pins 440, 441 which slidably extend through longitudinal elongated slots 442, 443 in the sides of the sear carrier near its front and back ends. The front sear carrier pin 440 extends through holes 444 (FIG. 13) extending through the receiver plates near the upper apex of each gusset plate, and through the rearwardly-located hole 445 formed in each receiver plate. It should be understood that the gusset plate hole 444, although disclosed in FIG. 13, is required only for the full-automatic gun 25'; likewise, the previously-described hole 305 in the gusset plates 306 is required only for the semi-automatic embodiment, and not for the presently-described full-automatic embodiment.

The sear 413 includes a flat bar 447 extending from back end 412, which extends behind the back end 452 of the sear carrier 435 as shown in FIG. 32, to the front end 448 located over the lug 453 extending inwardly from one side of the sear carrier. The sear pin opening 450 extends through the cylindrical portion of the sear below the flat bar 447, and the sear pin 449 extends through the sear pin opening and through aligned openings 451 on each side of the sear carrier 435, pivotably supporting the sear within the sear carrier. A sear compression spring 457 fits over the lug 458 at the back end 452 of the sear carrier, and extends upwardly to contact the underside of the sear bar 447 behind the pivot point of the sear. The sear spring 457 thus biases the sear 413 forwardly within the sear carrier 435, and the lug 453 provides a forward motion stop (FIG. 34) for the sear.

A foot 459 extends downwardly from the underside of the sear bar 447, a short distance behind the front end 448 of the sear bar. The lower end of the sear bar foot 459 provides a disconnector engaging surface 460 which engages the sear engaging surface 429 of the disconnector 424, in certain circumstances described below.

Figure 35:
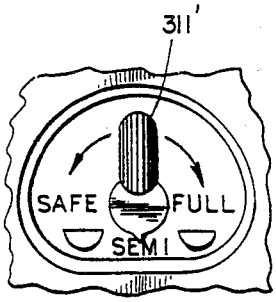
FIG. 35 is a fragmentary pictorial view showing the firing selector lever of the embodiment shown in FIG. 32.

The firing selector 421, mounted independently of the floating sear carrier 435, has a notched center region 463 positioned above the tail 425 of the trigger 418. A finger 464 extends outwardly from the center region 463, and this finger is aligned with the rear bearing surface 430 of the disconnector 424 when the selector 421 is rotated to the semi-automatic firing position "semi", FIG. 35, by manipulating the selector lever 311' extending outside the left stock shell of the gun 25'. When the firing selector is rotated to the "full" firing position, the disconnector-engaging finger 464 is rotated to the position shown in FIG. 34, out of possible engagement with the disconnector surface 430.

Moving the firing selector to the "safe" position places the safety lock surface 465 over the tail 425 of the trigger 418, blocking forward movement of the trigger so that the gun cannot be fired.

Operation of the full-automatic embodiment 25' is now considered. Assuming a cartridge magazine has been inserted as described previously, the charging handle is pulled back to engage and move the bolt carrier assembly 148' rearwardly. This rearward movement unlocks the bolt 150' in the manner described above for the semi-automatic embodiment, and the bolt moves rearwardly until the lug 410 on the bottom of the bolt rides over the back end 412 of the spring-biased sear 413. The sear rocks forwardly to engage the lug 410, locking the bolt 150' and the remainder of the bolt carrier assembly 148' in the open-bolt position shown in FIG. 33. The gun is now ready for firing in either the semi-automatic or full-automatic mode, depending on the position of the firing selector 421.

Figure 34:
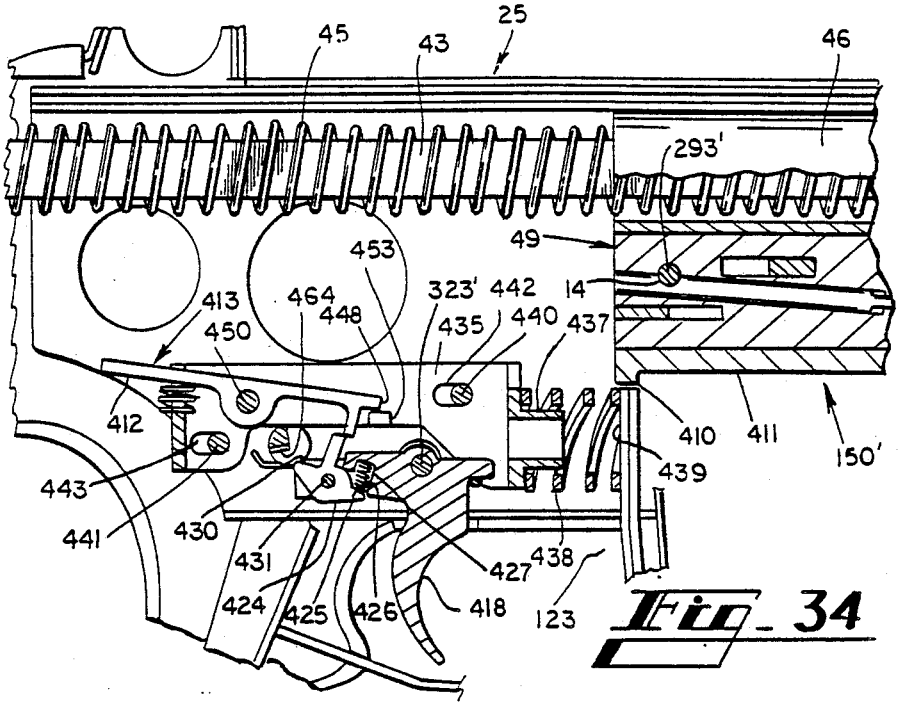
FIG. 34 is an elevation view of the firing mechanism shown in FIG. 32, with the bolt carrier assembly shown in full-forward position.

If full-auto firing is desired, the firing selector is rotated to the position shown in FIG. 34. When the trigger 418 is pulled, the disconnector 424 moves upwardly and forwardly with the trigger to engage the sear surface 460 with the sear engaging surface 429 of the disconnector. This engagement by the disconnector rotates the sear 413 counterclockwise about the sear pin 449, moving the sear back end 412 downwardly to release the lug 410 on the bolt 150'. The action spring 45 pushes the bolt carrier assembly 148' forward at this time, causing the bolt to strip the top round (not shown) from the cartridge magazine and chamber that round in the manner described above for the semi-automatic embodiment 25. Because the bolt 150' is latched in the position shown in FIG. 32 at this time, the forward end 296' of the firing pin 288' is held behind the front face 298 of the bolt and cannot strike the primer of the round being chambered.

As the bolt 150' enters the barrel extension, the bolt carrier catch is unlatched in the previous manner and the bolt carrier 149 moves forwardly relative to the bolt to cam upwardly the bolt lock 255 and lock the bolt 150' in the breach of the gun 25'. After the bolt is thus locked, the final increment of bolt carrier 149 movement relative to the bolt 150' moves the forward end 296' of the firing pin 288' through the firing pin opening 297' in the bolt, FIG. 34. The chambered round thus is fired, causing the gas piston rod 46 to move rearwardly in recoil as mentioned above.

Assuming the trigger 418 remains pulled, the sear 413 remains pivoted rearwardly and the back end 412 of the sear cannot engage the lug 410 on the underside of the bolt as the bolt carrier assembly 148' returns forwardly from its recoil position. The next cartridge in the magazine thus is loaded and fired, and this full-automatic firing cycle continues until the trigger is released, allowing the sear back end 412 to engage the bolt lug 410, or until the magazine is emptied.

If the firing selector 421 is moved to the "semi" position, the finger 464 is positioned over the back surface 430 of the disconnector 424. When the trigger 418 is pulled with the firing selector thus positioned, the finger 464 contacts the rear surface 430 of the disconnector as the trigger moves the disconnector upwardly to engage the sear surface 460. After the sear 413 is rocked counterclockwise to disengage the lug 410 of the cocked bolt, further trigger movement rotates the disconnector counterclockwise about the disconnector pivot pin 431, moving the disconnector arm 428 behind the sear foot 459 and thus allowing the sear spring 457 to return the sear 413 forwardly to its bolt-engaging position even though the trigger 418 remains pulled. The back end 412 of the sear thus can engage the bolt lug 410 and retain the bolt 150' in cocked open-bolt position after a single round-is fired. The buffer spring 438, together with the floating mounting of sear carrier 435 provided by pins 440, 441 through slots 442, 443 in the sear carrier, cushions the impact of the forwardly-traveling bolt striking the sear. When the trigger 418 is released, the disconnector spring 426 returns the disconnector 424 to its initial position, ready for firing another single round when the trigger 418 is pulled.

Figure 38:
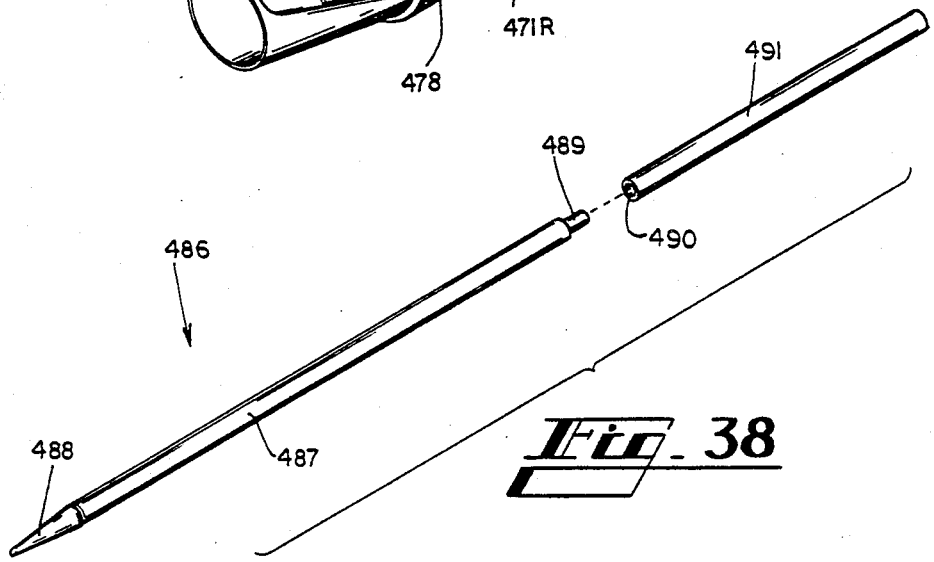
FIG. 38 is a pictorial view of a pin installation tool useful with the present invention.

In order to assist assembling a gun such as the guns 25 and 25', the assembly tool shown in FIG. 38 has been devised for inserting pivot pins such as the hammer pin, trigger pin, or the like. The assembly tool comprises the pin inserting tool 486, shown with the pin 491 which represents the actual pin being installed. The tool 486 has an elongated shank 487 with a point 488 at one end, and with a tail 489 of reduced diameter at the other end. The tail 489 fits into the hole 490 in one end of the pin 491.

To install a pivot pin such as the trigger pin in assembly with related parts including the trigger, disconnector, timing lever, and trigger spring, those parts first are assembled and manually held in their working relationship between the receiver plates. Pointed end 488 of the inserting tool can be temporarily inserted through the parts to assist alignment. The tool 486 and pin 491 now are interconnected by inserting the tail 489 in the hole 490, and the other end of the pin is inserted through the trigger pin hole 324 in one of the receiver plates and attached gusset plates. The pin 491 is worked into position through the aligned trigger pin holes in the trigger assembly parts and the receiver plates, with the connected tool 486 extending outside one receiver plate to assist in manipulating the pin through the parts. With the pin 491 fully installed so as to hold the trigger and related parts in assembly within the receiver plates, the tool 486 is withdrawn from the pin. Of course, the assembly tool may be used for other applications.

It should now be apparent to those of ordinary skill that the present invention, as exemplified in the two disclosed embodiments, meets the objectives recited above. Although both disclosed embodiments pertain to shotguns, it should also be apparent that most if not all of the disclosed novel features are readily adaptable to guns designed for firing rifled ammunition, particularly heavier calibers for which a locked-breach bolt is needed or preferred. Similarly, it should be apparent that the foregoing relates only to preferred embodiments of the present invention, and that numerous changes and modifications may be made therein without departing from the spirit or scope of the invention as defined in the following claims.

What is claimed is:

1. Bolt locking mechanism for a firearm including a breech, comprising:

a bolt carrier selectively movable on a predetermined path;

a bolt movable with the bolt carrier either to a forward position relative to the breech of the forearm, or to a rearward position, the bolt carrier being associated with the bolt to allow the bolt carrier a limited extent of forward travel beyond the forward position of the bolt;

cam means associated with the bolt carrier and extending longitudinally of the bolt carrier;

the bolt having a hollow portion within which the cam means moves as the bolt carrier travels relative to the bolt;

lock means movable with the bolt and operable by said cam means, in response to the limited extent of forward travel by the bolt carrier, to move vertically relative to the bolt on a path normal to the path of bolt movement, so as to extend upwardly from the top of the bolt and engage the breech, locking the bolt in the forward position;

the lock means being disposed in the hollow portion of the bolt;

the lock means including surfaces defining a window extending within the hollow portion of the bolt along a path generally parallel to the path of bolt movement, and receiving the longitudinally-extending cam means in operative relation with the window-defining surfaces, so that the cam means moves the lock means vertically to lock or unlock the bolt as the cam means moves longitudinally within the window in the hollow portion of the bolt.

2. Bolt locking mechanism for a gas-operated firearm having a barrel, a magazine-receiving well disposed below a breech end of the barrel to receive a magazine for feeding rounds upwardly into the breech end, a gas piston assembly located above the barrel, and a side ejection means at a side of the breech for ejecting spent shells, comprising in combination:

a bolt carrier selectively movable on a predetermined path relative to the breech;

a bolt movable with the bolt carrier either to a forward position relative to the breech of the firearm, or to a rearward position, the bolt carrier being associated with the bolt to undergo a limited extent of forward travel beyond the forward position of the bolt;

a barrel extension secured to the breech end of the barrel and receiving the bolt in forward position, the barrel extension having a lower side comprising a cartridge feed ramp located immediately in front of the magazine well and sloped upwardly to assist in feeding shells from the magazine into the breech;

the barrel extension having a top surface located below the gas piston and above the bolt in forward position, with a hole formed in the top surface in confronting relation to the top of the bolt;

the bolt having a hallow passage with a vertical axis aligned with the axis of the barrel extension hole when the bolt is in forward position;

a bolt lock member slidably disposed in the bolt passage for selective vertical movement therein;

the bolt having a open interior region substantially parallel to the path of travel of the bolt and intersecting the bolt passage, such that the bolt lock member is partially within the open interior region;

the bolt lock member having first and second cam follower means within the interior region;

a cam member on the bolt carrier and extending longitudinally into the interior region of the bolt;

the cam member having a first cam surface coacting with the first cam follower means on the bolt lock member to move the bolt lock member upwardly into engagement with the hole in the top surface of the barrel extension when the bolt carrier undergoes forward travel beyond the forward position of the bolt, thereby locking the bolt within the breech;

the cam member having a second cam surface coacting with the second cam follower means on the bolt lock member to move the bolt lock member downwardly out of engagement with the hole in the top surface of the barrel extension when the bolt carrier travels rearwardly relative to the bolt, thereby unlocking the bolt for rearward travel with the bolt carrier;

the bolt lock member having a window having an extent substantially perpendicular to the vertical movement of the bolt lock member;

the window being within the open interior region of the bolt, and having upper and lower extent comprising the first and second cam follower means; and the cam member comprises an elongate element extending forwardly of the bolt carrier to enter the window, and having said first and second cam surfaces on upper and lower portions of the elongate element in confronting and coacting relation with the upper and lower extents of the window.

3. Bolt locking mechanism for an autoloading firearm including a breech, a magazine mounted below the breech for feeding rounds upwardly, and a side ejection port for ejecting spent shells, comprising in combination:

a bolt carrier selectively movable on a predetermined path relative to the breech;

a bolt movable with the bolt carrier either to a forward position relative to the breech of the firearm, or to a rearward position, the bolt carrier being associated with the bolt to undergo a limited extent of forward travel beyond the forward position of the bolt;

a hallow passage formed in the bolt and defining a generally vertical axis;

lock means disposed in the hollow passage and selectively slidable therein along the vertical axis between upper and lower positions;

lock engaging means located above the bolt in the forward position and disposed in fixed relation to the breech, said lock engaging means being engaged by the lock means in the upper position to lock the bolt in the forward position;

cam means associated with the bolt carrier and extending into the bolt for operative engagement with the lock means;

the cam means having an upper cam surface contacting a mating first cam follower surface on the lock means to move the lock means upwardly and lock the bolt in the forward position, when the bolt carrier undergoes the limited extent of forward travel beyond the forward position of the bolt;

the cam means having a lower cam surface contacting a mating second cam follower surface on the lock means to move the lock means downwardly and unlock the bolt as the bolt carrier travels rearwardly said limited extent relative to the bolt;

the cam means comprising an elongated finger extending forwardly of the bolt carrier; and the lock means having a window extending therein along a path perpendicular to said vertical axis and receiving the elongate finger for movement within the window as the bolt carrier travel forwardly and rearwardly relative to the bolt.

4. Apparatus as in claim 3, wherein:

the elongated finger has an upper side angled to define the upper cam surface and a lower side angled to define the lower cam surface; and the windows of the lock means has upper and lower surfaces selectively engaging the upper and lower cam surfaces of the elongate finger.

5. Apparatus as in claim 3, wherein:

the elongated finger has an upper side with a first ramp surface angled relative to the path of travel of the bolt carrier and engaging a mating angled follower surface at an upper end of the window in the lock means, so as to move the lock means upwardly within the passage in the bolt and into the lock engaging means as the bolt carrier moves forward a first portion of the forward travel relative to the bolt; and the upper side having a second surface comprising a holding surface longitudinally spaced from the first ramp surface and substantially parallel to the travel path of the bolt carrier, the holding surface moving into engagement with a complementary holding surface spaced on the upper end of the window from the angled follower surface thereon as the bolt carrier moves forwardly beyond the first portion of forward travel relative to the bolt, thereby holding the locking means in the upper position engaging the lock

6. Apparatus as in claim 5, wherein:

the elongate finger has a lower side with a second ramp surface angled relative to the path of travel of the bolt carrier and engaging a mating angled second follower surface at a lower end of the window in the lock means, so as to move the lock means downwardly within the passage in the bolt and out of engagement with the lock engaging means as the bolt carrier moves rearwardly a first portion of the rearward travel relative to the bolt;

the lower side having a second surface comprising a second holding surface longitudinally spaced from the second ramp surface and substantially parallel to the travel path of the bolt carrier, the second holding surface moving into engagement with a complementary second holding surface spaced on the lower end of the window from the second follower surface thereon as the bolt carrier moves rearwardly beyond the first portion of rearward travel relative to the bolt, thereby holding the locking means in the lower position out of engagement with the lock engaging means as the bolt undergoes further rearward travel with the bolt carrier.

7. Bolt locking mechanism for an autoloading firearm including a breech, a magazine mounted below a breech for feeding rounds rearwardly, and a side ejection port for ejecting spent shells, comprising in combination:

a bolt carrier selectively movable on a predetermined path relative to the breech;

a bolt movable with the bolt carrier either to a forward position relative to the breech of the firearm, or to a rearward position, the bolt carrier being associated with the bolt to undergo a limited extent of forward travel beyond the forward position of the bolt;

a hollow passage formed in the bolt and defining a generally traverse axis in relation to the travel of the bolt;

lock means disposed in the hollow passage and selectively slidable therein along the transverse axis between outer and inner positions;

lock engaging means located transversely alongside the bolt in the forward position and disposed in fixed relation to the breech, said lock engaging means being engaged by the lock means in the outer position to lock the bolt in the forward position cam means associated with the bolt carrier and extending into the bolt for operative engagement with the lock means;

the cam means having an outer cam surface contacting a mating first cam follower surface on the lock means to move the lock means outwardly and lock the bolt in the forward positions, when the bolt carrier undergoes the limited extent of forward travel beyond the forward position of the bolt;

the cam means having an inner cam surface contacting a mating second cam follower surface on the lock means to move the lock means inwardly and unlock the bolt as the bolt carrier travels rearwardly said limited extent relative to the bolt;

the cam means comprising an elongated finger extending forwardly of the bolt carrier; and the lock means having a window extending therein along a path perpendicularly to said transverse axis and receiving the elongate finger for movement within the window as the bolt carrier travels forwardly and rearwardly relative to the bolt.

* * * * *